US012716656B2

(12) United States Patent
Ravindranath

(10) Patent No.: US 12,716,656 B2
(45) Date of Patent: Aug. 25, 2026

(54) THERMAL MANAGEMENT SYSTEM AND METHOD

(71) Applicant: Transportation IP Holdings, LLC, Norwalk, CT (US)

(72) Inventor: Balaji Hosadurgam Ravindranath, Mysore (IN)

(73) Assignee: Transportation IP Holdings, LLC, Norwalk, CT (US)

( * ) Notice: Subject to any disclaimer, the term of this patent is extended or adjusted under 35 U.S.C. 154(b) by 680 days.

(21) Appl. No.: 18/164,588

(22) Filed: Feb. 5, 2023

(65) Prior Publication Data

US 2023/0280110 A1 Sep. 7, 2023

Related U.S. Application Data

(60) Provisional application No. 63/347,082, filed on May 31, 2022, provisional application No. 63/315,724, filed on Mar. 2, 2022.

(51) Int. Cl.
*F28D 1/04* (2006.01)
*F28D 1/047* (2006.01)
(Continued)

(52) U.S. Cl.
CPC ..... *F28D 1/0417* (2013.01); *F28D 1/0435* (2013.01); *F28D 1/0472* (2013.01);
(Continued)

(58) Field of Classification Search
CPC .... F28D 1/0417; F28D 1/0435; F28D 1/0472; F28D 7/04; F28D 7/106; F28D 21/00;
(Continued)

(56) References Cited

U.S. PATENT DOCUMENTS 1,428,718 A * 9/1922 Sturtevant ..... F28D 1/053 165/72
1,965,011 A * 7/1934 Swan ..... C10G 5/06 165/286

(Continued)

FOREIGN PATENT DOCUMENTS

JP H06199300 A 7/1994

OTHER PUBLICATIONS

Extended European Search Report for corresponding EP Application No. 23157885.7 dated Jul. 12, 2023 (7 pages).

*Primary Examiner* — Eric S Ruppert
*Assistant Examiner* — Hans R Weiland
(74) *Attorney, Agent, or Firm* — K&L Gates LLP

(57) ABSTRACT

An apparatus of a thermal management system and method of operating therein may include an outer annular support member that extends about an outer axis of the outer annular support member, and an inner annular support member that is nested within the outer annular support member. The inner annular support member extends about an inner axis of the inner annular support member. The inner annular support member has a size that is less than a size of the outer annular support member. The apparatus may include plural tubes that connect with and radially extend from the outer annular support member to the inner annular support member. Each of the plural tubes may extend along different pathways between the outer annular support member and the inner annular support member.

17 Claims, 15 Drawing Sheets

(51) Int. Cl.

| | |
|---|---|
| ***F28F 1/00*** | (2006.01) |
| ***F28F 9/007*** | (2006.01) |
| *F28D 1/02* | (2006.01) |
| *F28D 21/00* | (2006.01) |

(52) U.S. Cl.
CPC ..... *F28F 1/006* (2013.01); *F28F 9/007* (2013.01); *F28D 2001/0273* (2013.01); *F28D 2021/0028* (2013.01)

(58) Field of Classification Search
CPC ..... F28D 2001/0273; F28D 2021/0028; F28F 1/006; F28F 9/007; F28F 2265/16; F24F 11/36
See application file for complete search history.

(56) References Cited

U.S. PATENT DOCUMENTS

| | | | | | |
|---|---|---|---|---|---|
| 2,479,071 | A * | 8/1949 | Henstridge | F28D 7/0058 | 165/172 |
| 4,063,589 | A * | 12/1977 | Battcock | F28D 7/04 | 34/578 |
| 5,117,904 | A * | 6/1992 | Bond | F28F 9/22 | 165/163 |
| 2005/0056408 | A1 * | 3/2005 | Gregory | F28F 9/026 | 165/151 |
| 2018/0051935 | A1 * | 2/2018 | Roberge | F28D 9/0018 | |
| 2021/0247152 | A1 * | 8/2021 | Roberge | F28D 7/1638 | |
| 2021/0270534 | A1 | 9/2021 | Emo et al. | | |

* cited by examiner

THERMAL MANAGEMENT SYSTEM AND METHOD

CROSS-REFERENCE TO RELATED APPLICATIONS

This application claims priority to U.S. Provisional Application No. 63/315,724, filed 2 Mar. 2022, and claims priority to U.S. Provisional Application No. 63/347,082, filed 31 May 2022. The entirety of these applications are incorporated herein by reference.

BACKGROUND

Technical Field

The subject matter described relates to fluid thermal management system and methods.

Discussion of the Art

Heat exchangers, such as radiators, may include oil, water and air as working media that is to be cooled or is heated. For example, heat exchangers may be used with engines for transferring heat between different bodies or volumes. For example, a first fluid at a relatively high temperature may pass through a first passageway, and a second fluid at a relatively low temperature may pass through a second passageway. The first and second passageways may be in thermal contact or close proximity, allowing heat from the first fluid to be passed to the second fluid. Thus, the temperature of the first fluid may be decreased and the temperature of the second fluid may be increased.

Typically, heat exchangers include a fin-tube design, with the tubes extending in substantially straight directions between an inlet header and an outlet header. The inlet and outlet headers may be disposed in different axial planes. A first fluid may move within the straight tubes between the inlet and outlet headers. Optionally, a fan may blow a second fluid, such as cooling air, toward the tubes to promote the transfer of thermal energy between a fluid moving within the tubes and the cooling air. One technical problem of existing heat exchangers is the aligned straight sections of the tubes, which fail to promote the efficiency of transferring heat between the fluids as the fluid moves within the straight sections, which experience pressure drops across fluid passages, etc. Additionally, the straight sections are limited to an available corresponding area, owing to the design of the straight sections. The tube-fin heat exchanger arrangements may be constrained by packaging, assembly, and manufacturing methods.

It may be desirable to have a thermal management system and method that differs from those that are currently available.

BRIEF DESCRIPTION

In according with one example or aspect, an apparatus may include an outer annular support member that extends about an outer axis of the outer annular support member, and an inner annular support member that is nested within the outer annular support member. The inner annular support member extends about an inner axis of the inner annular support member. The inner annular support member has a size that is less than a size of the outer annular support member. The apparatus may include plural tubes that connect with and extend from the outer annular support member to the inner annular support member. Each of the plural tubes may extend along curved pathways between the outer annular support member and the inner annular support member.

In accordance with one example or aspect, a method may include directing a fluid into a first interior cavity of an inner annular support member of an apparatus, and directing the fluid out of the first interior cavity and through plural tubes connected with and radially extending from the inner annular support member to an outer annular support member. Each of the plural tubes may include one or more surfaces defining interior passages of the plural tubes. Each of the plural tubes may extend along curved pathways between the outer annular support member and the inner annular support member. The fluid may be received within a second interior cavity of the outer annular support member of the apparatus. The inner annular support member may be nested within the outer annular support member.

In accordance with one example or aspect, a thermal management system may include an inner annular support member that extends about an axis. The inner annular support member may include one or more surfaces defining a first interior cavity. An outer annular support member extends about the axis such that the inner annular support member and the outer annular support member are concentric. The inner annular support member being nested within the outer annular support member. The outer annular support member may include one or more surfaces defining a second interior cavity. The thermal management system includes plural tubes connected and radially extending from the outer annular support member to the inner annular support member. Each of the plural tubes may include one or more surfaces defining interior passages of each of the plural tubes. Each of the plural tubes may extend along curved pathways between the outer annular support member and the inner annular support member. The curved pathways of the plural tubes may be spiral curves along long axes of the plural tubes. The first interior cavity is fluidly coupled with each of the interior passages and to the second interior cavity. A fluid may be directed through the first interior cavity toward one or more of the interior passages, and through the one or more interior passages toward the second interior cavity.

In accordance with one example or aspect, an apparatus may include an outer annular support member extending about an outer axis and an inner annular support member that is nested within the outer annular support member. The inner annular support member extends about an inner axis. Plural tubes may be connected with and extend between the outer annular support member and the inner annular support member. Each of the plural tubes may radially extend between a first end operably coupled with the inner annular support member and a second end operably coupled with the outer annular support member. A first end of a first tube of the plural tubes may be offset from a first end of a second tube of the plural tubes in a circumferential direction and in an axial direction. A second end of the first tube may be offset from a second end of the second tube in the circumferential direction and in the axial direction. A first fluid may be directed into one of the inner annular support member or the outer annular support member, through the plural tubes, and out of the other of the inner annular support member or the outer annular support member.

In accordance with one example or aspect, a thermal management system may include an outer annular support member that extends about an outer axis, and an inner annular support member that is nested within the outer annular support member and extends about an inner axis. The thermal management system may include plural tubes connected with and radially extending between the outer annular support member and the inner annular support member. Each of the plural tubes may extend between a first end operably coupled with the inner annular support member and a second end operably coupled with the outer annular support member. A first end of a first tube of the plural tubes may be offset from a first end of a second tube of the plural tubes in a circumferential direction and in an axial direction; and a second end of the first tube may be offset from a second end of the second tube in the circumferential direction and the axial direction. The first end of the first tube may be aligned with the second end of the first tube in the axial direction and the first end of the first tube may be offset from the second end of the first tube in the circumferential direction. The first end of the second tube may be aligned with the second end of the second tube in the axial direction, and the first end of the second tube may be offset from the second end of the second tube in the circumferential direction. A first fluid may be directed into one of the inner annular support member or the outer annular support member, through the plural tubes, and out of the other of the inner annular support member or the outer annular support member.

BRIEF DESCRIPTION OF THE DRAWINGS

The inventive subject matter may be understood from reading the following description of non-limiting embodiments, with reference to the attached drawings, wherein below.

Start of 1693PR2 Figures

Figure 10:
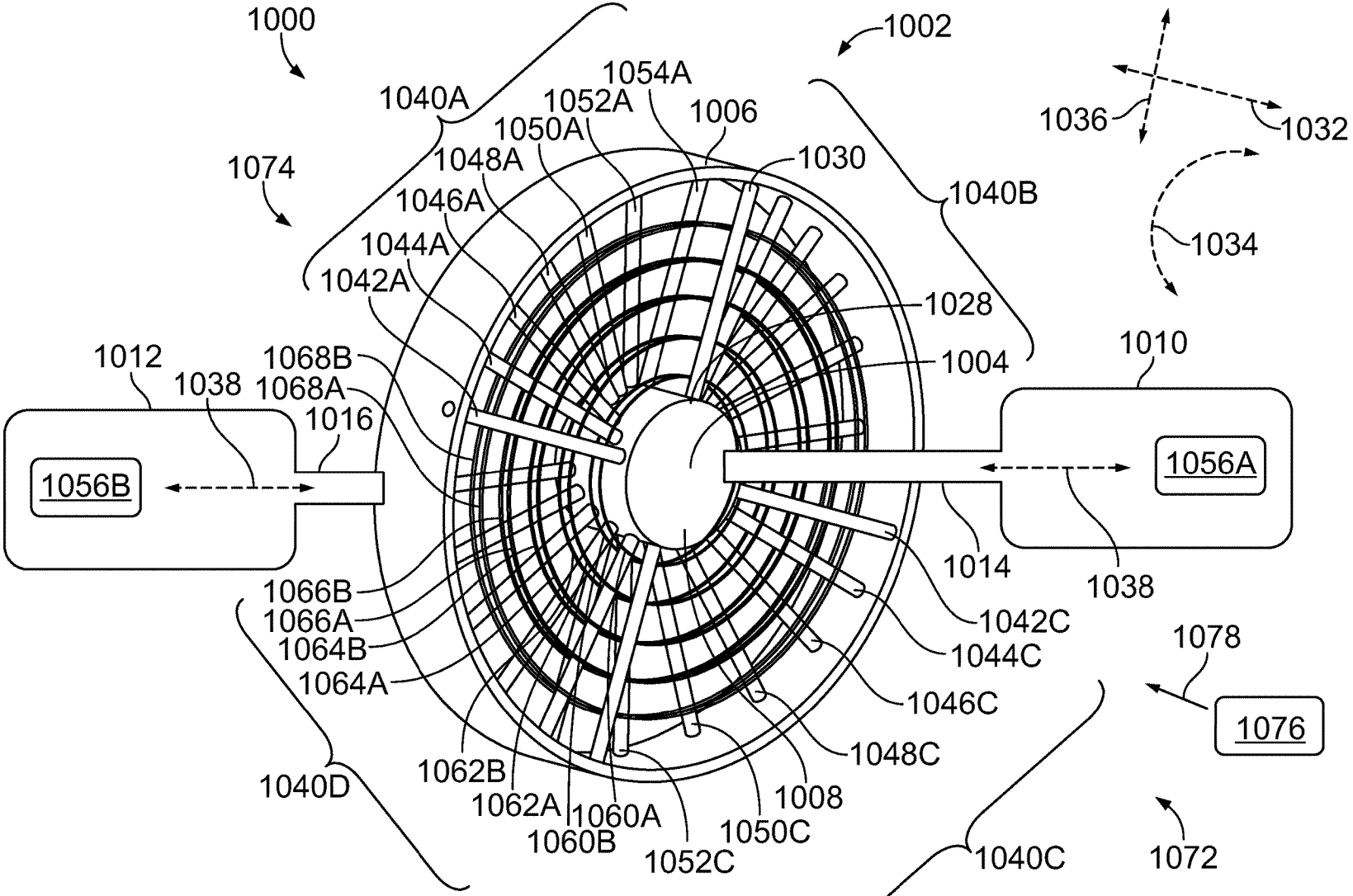
Figure 11:
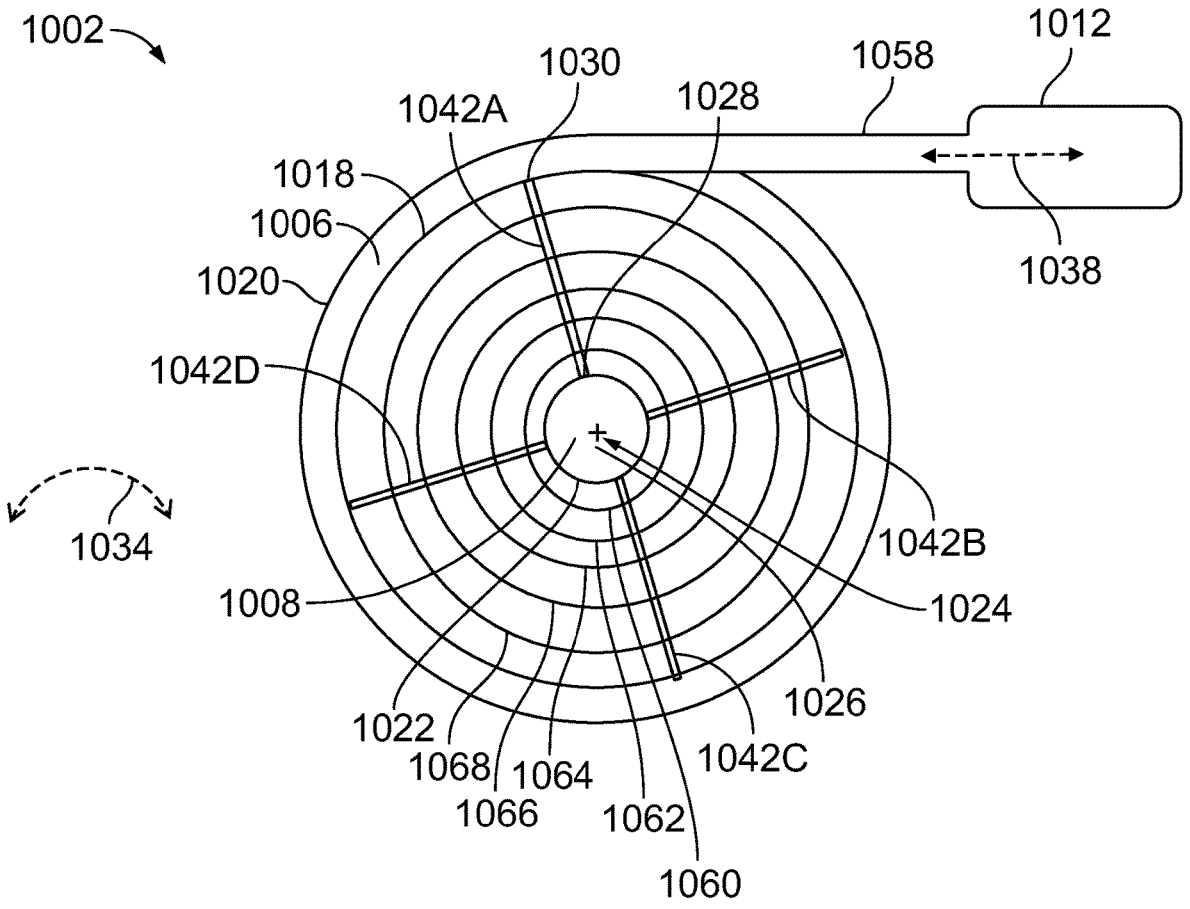
Figure 13:
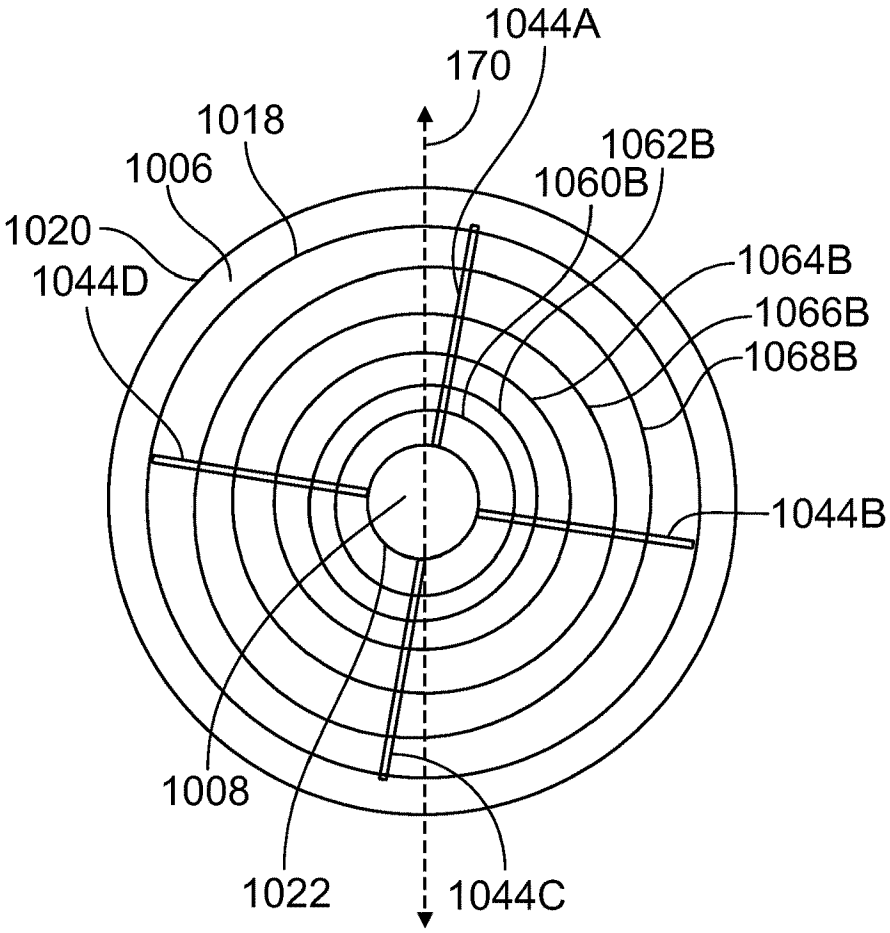
Figure 12:
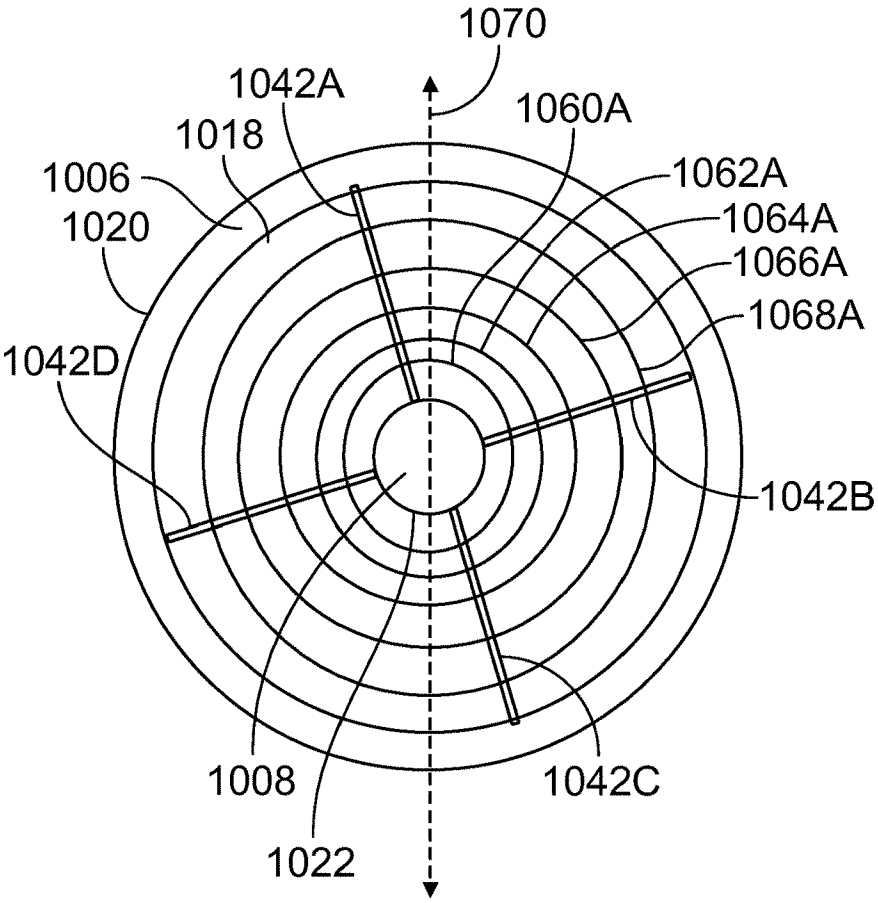
Figure 14:
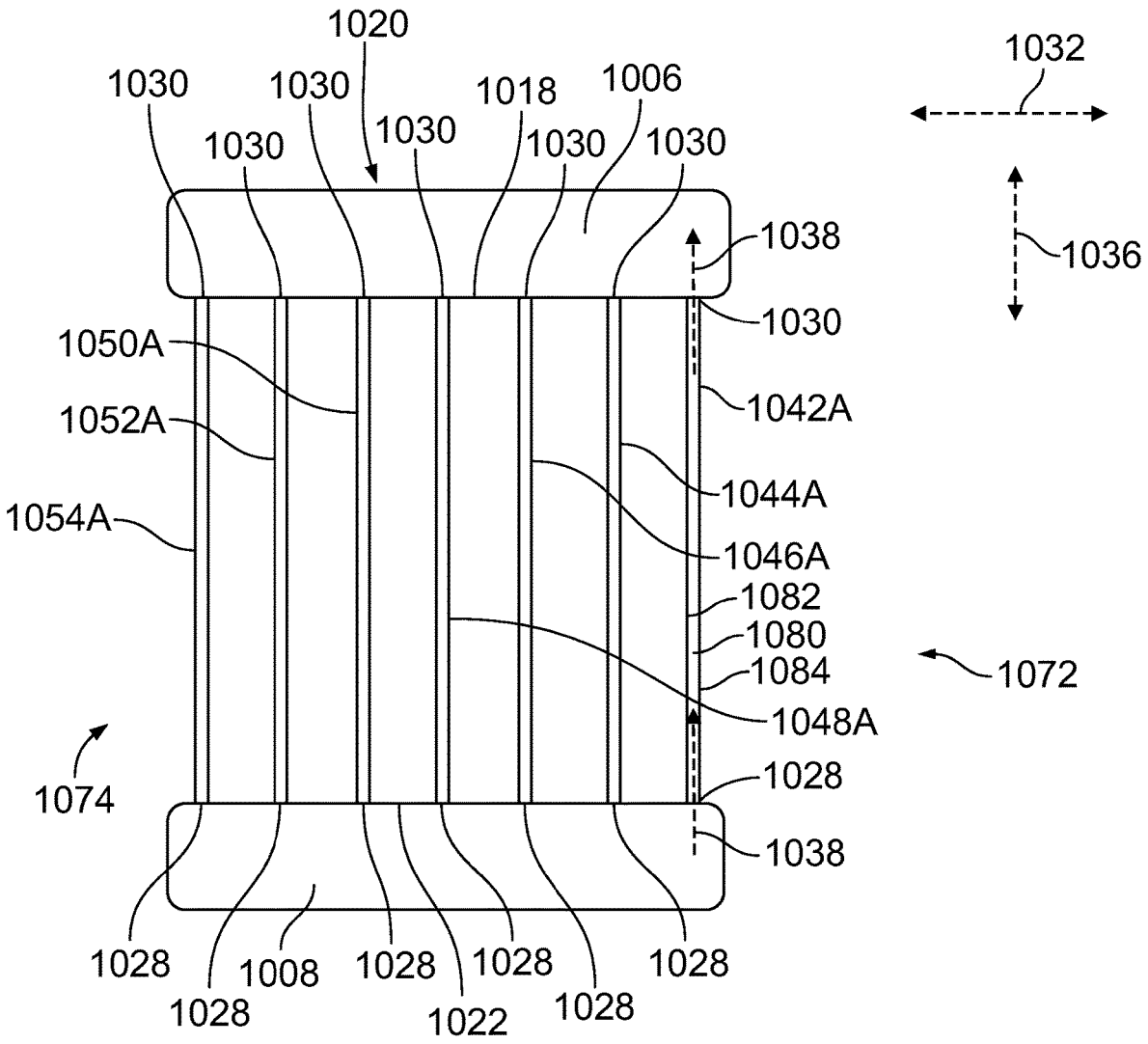
Figure 15:
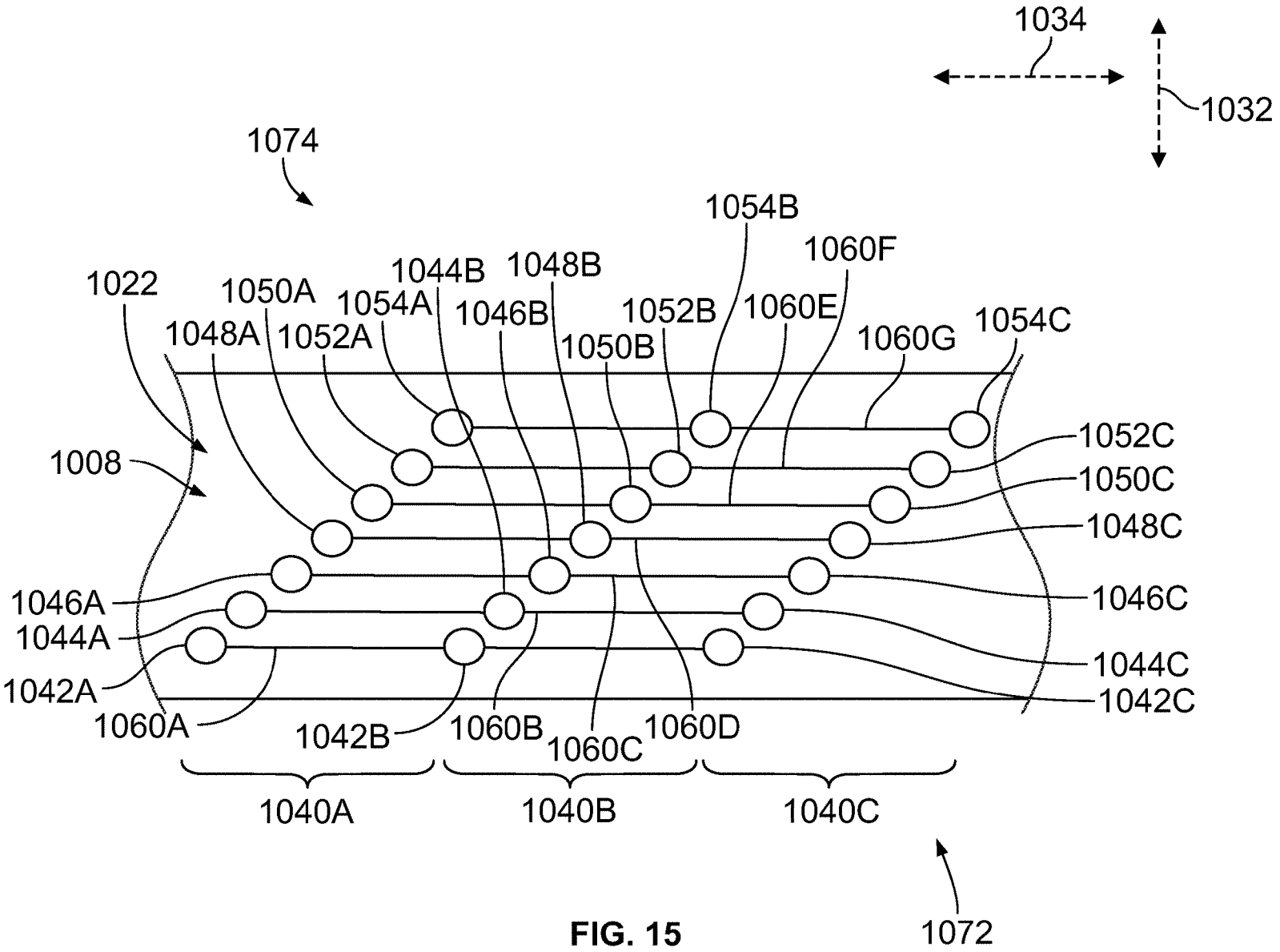
Figure 16:
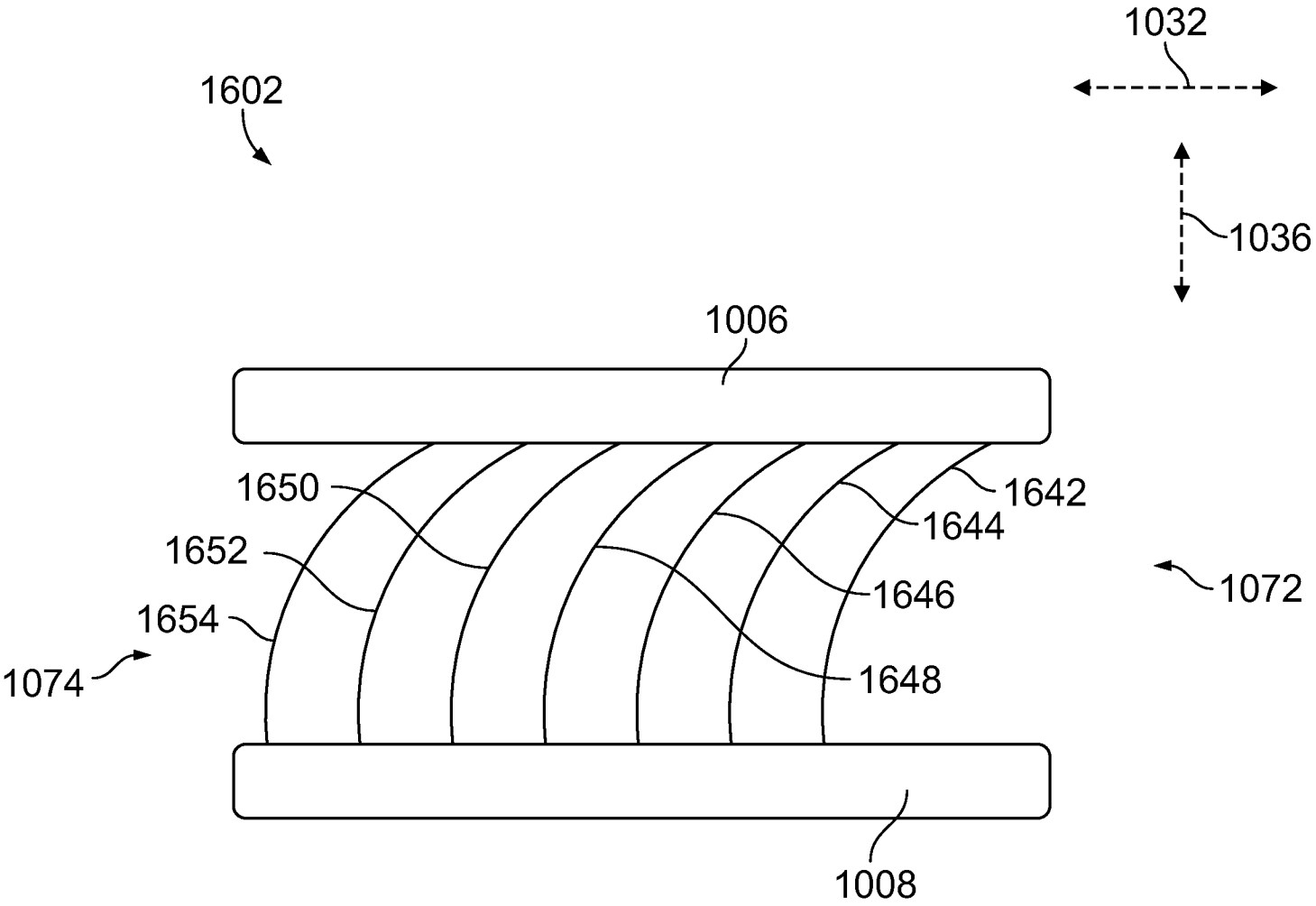
Figure 17:
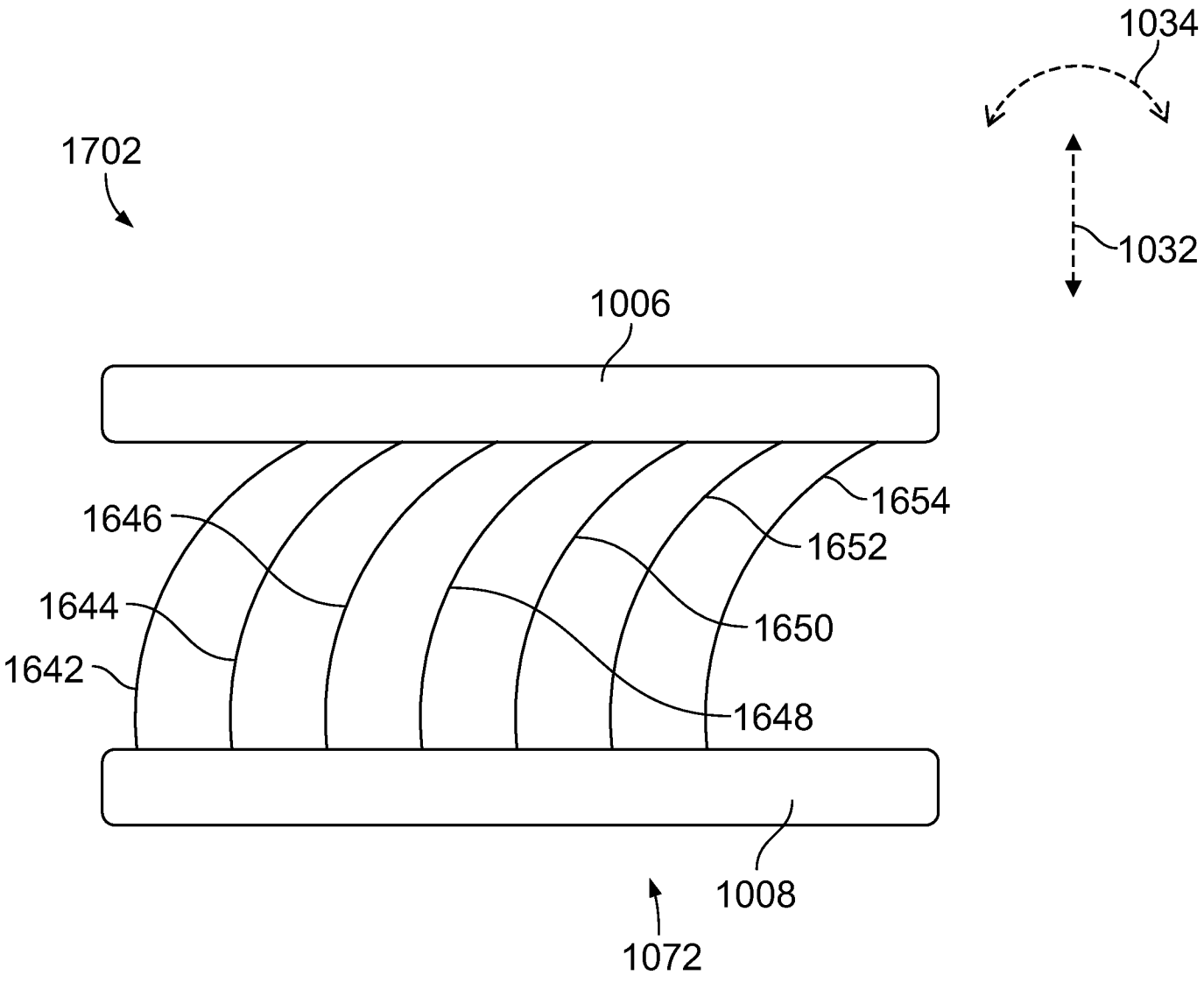
Figure 18:
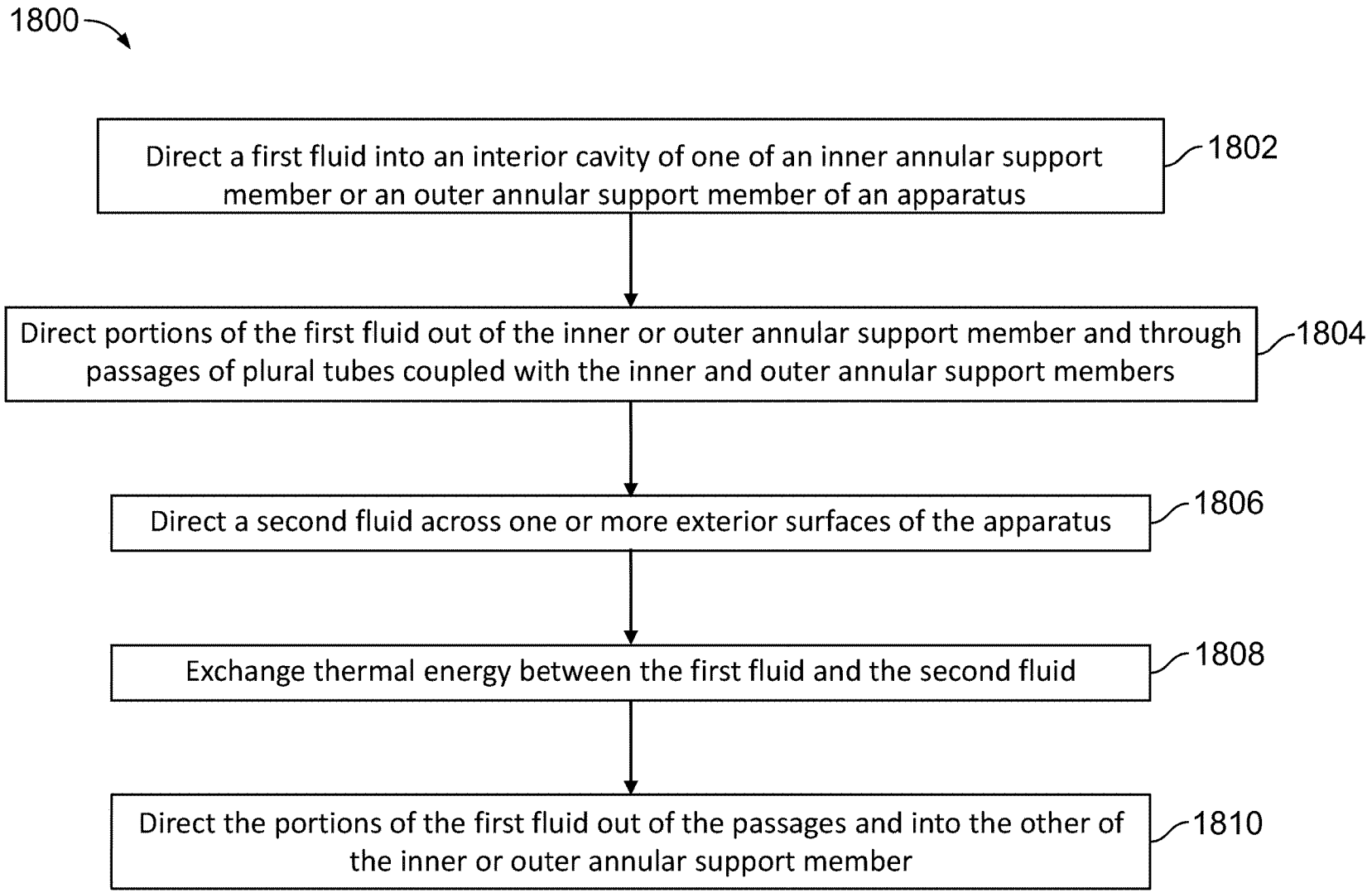

FIG. 10 illustrates a perspective view of a thermal management system in accordance with one embodiment;

FIG. 11 illustrates a front view of first cross-sectional view of an apparatus of the thermal management system shown in FIG. 10;

FIG. 12 illustrates the front view of the first cross-sectional plane of the apparatus shown in FIG. 10;

FIG. 13 illustrates a front view of a second cross-sectional plane of the apparatus shown in FIG. 10;

FIG. 14 illustrates a side partial cross-sectional view of an apparatus of the thermal management system shown in FIG. 10;

FIG. 15 illustrates a top partial cross-sectional view of the apparatus shown in FIG. 14;

FIG. 16 illustrates a side partial cross-sectional view of an apparatus of a thermal management system in accordance with one embodiment;

FIG. 17 illustrates a front partial cross-sectional via of an apparatus of a thermal management system in accordance with one embodiment; and FIG. 18 illustrates a method of controlling fluids within a thermal management system in accordance with one embodiment.

DETAILED DESCRIPTION

Embodiments of the subject matter described herein relate to thermal management systems (e.g., heat exchangers) and methods that include plural fluidly separate tubes or conduits that extend in radial pathways between an inner annular support member and an outer annular support member. In one embodiment, at least one of the plural tubes may radially extend in a curved pathway between inner and outer annular support members. In another embodiment, at least one of the plural tubes may radially extend in a linear pathway between the inner and outer annular support members.

The curved radial pathways may direct portions of a fluid to move in a clockwise direction, and/or portions of the fluid to move in a counter-clockwise direction. The curved pathways may be spiral curves that extend along axes of each of the plural tubes. The spiral curves may be golden spiral curves, logarithmic spiral curves, approximate golden spiral curves, non-uniform rational basis spline (NURBS) based curves, freeform curves, curves defined by splines, mathematically represented curves, or the like. The curved pathways of the plural tubes increases a surface area of the plural tubes that may interact with a second fluid that moves across exterior surfaces of the plural tubes.

Additionally or alternatively, embodiments of the subject matter described herein relate to thermal management systems (e.g., heat exchangers) and methods that include plural, fluidly-separate tubes or conduits that extend in the linear radial pathways between an inner annular support member and an outer annular support member. The plural tubes radially extending in spiral pathways such that a first end of a first tube is offset from a first end of a second tube in a circumferential direction and an axial direction, and a second end of the first tube is offset from a second end of the second tube in the circumferential and axial directions. For example, the plural tubes are arranged in a spiral configuration between the inner and outer annular support members.

In one or more embodiments, the plural tubes may be separated into sets of tubes. For example, a first set of the plural tubes may extend along first curved radial pathways such as to direct portions of the fluid in a clockwise direction, and a second set of the plural tubes may extend along second radial curved pathways such as to direct portions of the fluid in a counter-clockwise direction. The plural tubes may be fluidly separate from each other, and may be separated from each other along an axis. For example, the separation between adjacent tubes provides a space or void between the adjacent tubes through which the second fluid may move to control the thermal energy of the fluid moving within the tubes. Optionally, each tube in a first set of the plural tubes may be axially and circumferentially offset from each other. Additionally, the tubes of the first set may be axially aligned with corresponding tubes of another set of the plural sets of tubes about an axis of the apparatus. The plural tubes may be fluidly separate from each other, and may be separated from each other in the axial and circumferential directions. For example, the separation between adjacent tubes provides a space or void between the adjacent tubes through which a second fluid may move to control the thermal energy of the first fluid moving within the tubes.

The thermal management system may be used in conjunction with heat generating sources (e.g., engines, fuel cells, and/or the like). For example, the thermal management system may be used within engines such as those associated with stationary and/or moving or mobile vehicle systems including, but not limited to, automobiles, trucks, buses, mining vehicles, marine vessels, aircraft (manned or unmanned, such as drones), agricultural vehicles, locomotives, stationary engines, or other off-highway vehicles. As one example, the thermal management system may be used with or in association with an EGR cooler system, such as part of an internal combustion engine. Optionally, the thermal management system may be used with stationary power systems such as industrial power systems, wind or other turbines, electronics cooling, renewable energy systems, water treatment facilities, any domestic or commercial cooling systems, personal appliances or other systems, or the like.

Figure 1:
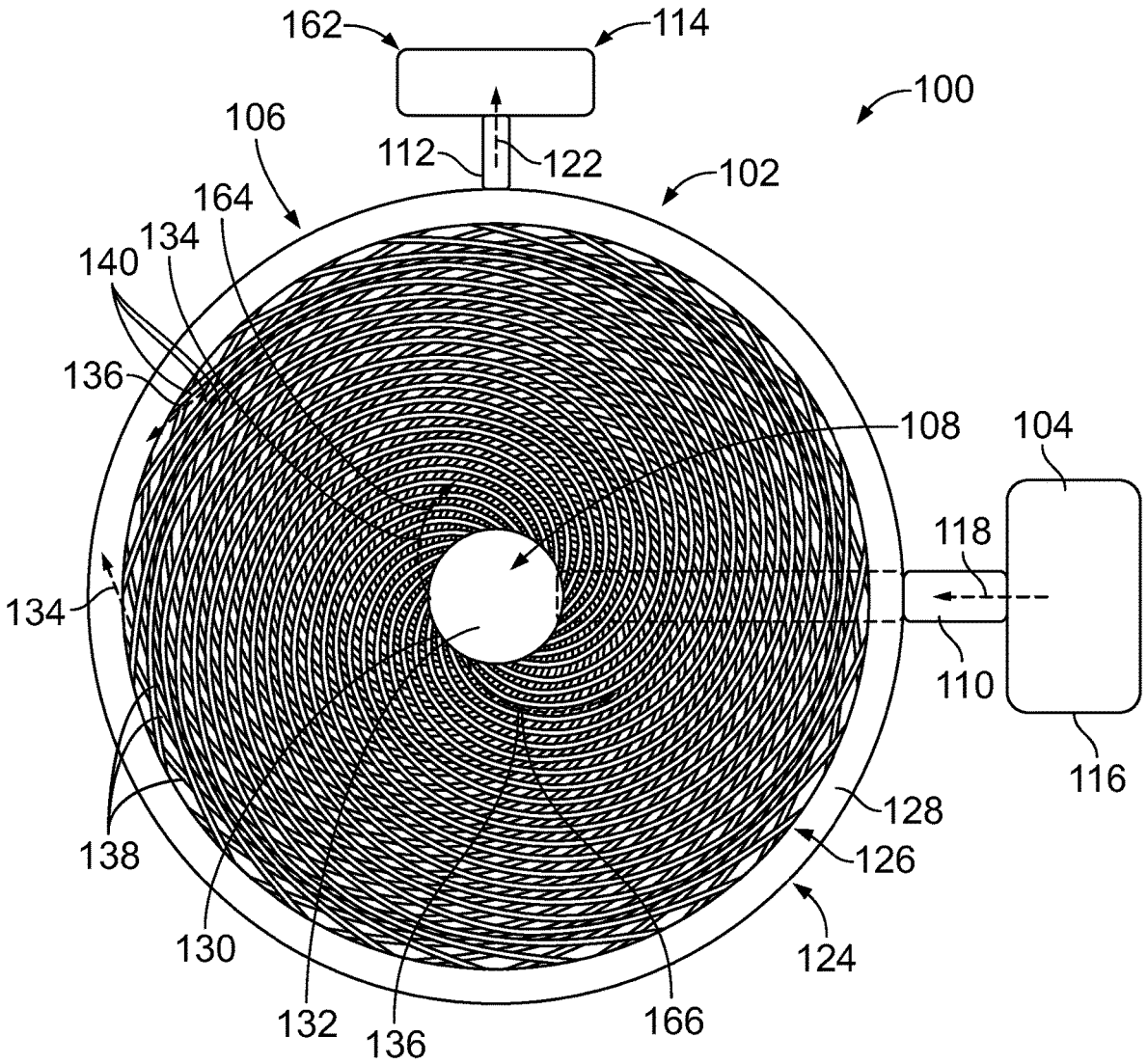
FIG. 1 illustrates a front view of a thermal management system in accordance with one embodiment.
Figure 2:
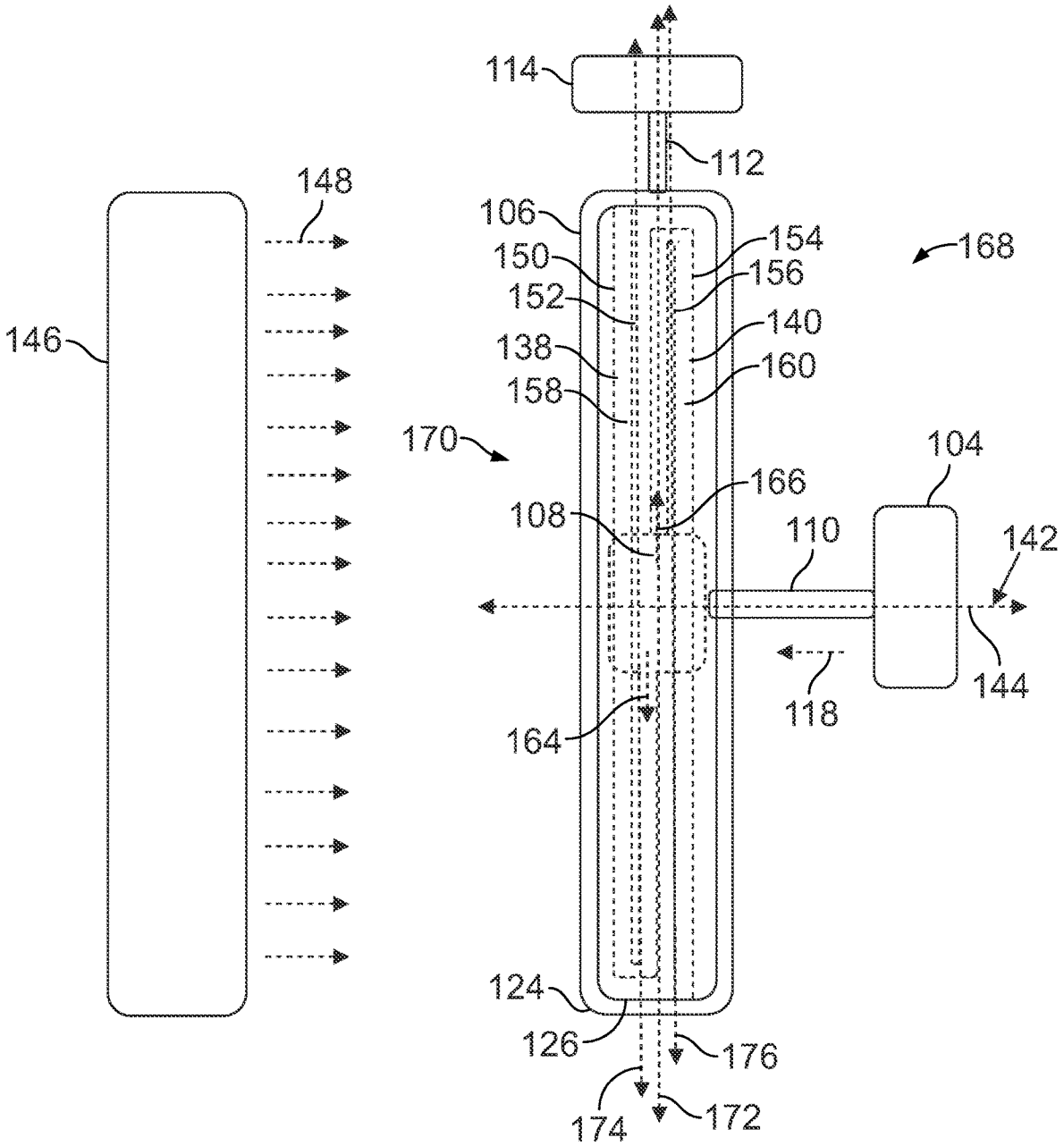
FIG. 2 illustrates a side cross-sectional view of the thermal management system shown in FIG. 1.

FIG. 1 illustrates a front view of a thermal management system 100 in accordance with one embodiment. FIG. 2 illustrates a side cross-sectional view of the thermal management system shown in FIG. 1. The system and the X-Y-Z coordinate system are used herein only for the purpose of explaining aspects of the subject matter and are not intended to limit the scope of the disclosure. In this regard, directional indicators such as "left" and "right," "front" and "back," and "top" and "bottom" are only used to indicate the relative positioning of two sides of the system along the X-direction, the Y-direction, and the Z-direction, respectively.

The system includes an apparatus 102 that is fluidly coupled with a first reservoir 104 and a second reservoir 114. Optionally, the system may include two or more first reservoirs that may direct one or more different fluids into the apparatus. In one or more embodiments, the first reservoir(s) may be referred to as inlet reservoirs, such that fluid is directed into the apparatus via the inlet reservoir(s). Optionally, the system may include two or more second reservoirs that may direct the fluids out of the apparatus. In one or more embodiments, the second reservoir(s) may be referred to as outlet reservoirs, such that fluid is directed out of the reservoir via the outlet reservoir(s). Optionally, fluid may be directed into and out of the apparatus by any alternative configuration. For example, fluid may be directed into the apparatus via the second reservoir(s), and may be directed out of the apparatus via the first reservoir(s).

The apparatus includes an outer annular support member 106 and an inner annular support member 108. In the illustrated embodiment of FIGS. 1 and 2, the inner annular support member is nested within the outer annular support member. For example, the inner annular support member is positioned within an area defined by the outer annular support member. Additionally, the inner annular support member has a size that is smaller than the outer annular support member. In the illustrated embodiment, the outer annular support member has a circular shape, and the inner annular support member has a circular shape that is substantially the same as the circular shape of the outer annular support member. Optionally, the inner and/or outer annular support members may have an alternative shape, such as an oval, or rectangular shape. Optionally, the inner annular support member may have a shape that differs from the shape of the outer annular support member.

In another embodiment, the inner annular support member may have a size that is substantially the same as a size of the outer annular support member. For example, the inner and outer annular support members may be positioned or lie on a periphery of a defined radius. In another embodiment, the inner annular support member may have a size that is greater than a size of the outer annular support member. For example, the inner annular support member may lie on a defined radius that is greater than a defined radius of the outer annular support member.

The inner annular support member extends about an inner axis 142, and the outer annular support member extends about an outer axis 144. In the illustrated embodiment, the inner axis is aligned with the outer axis such that the inner annular support member is concentric with the outer annular support member, i.e. they share the same center. Alternatively, the inner axis may be misaligned with the outer axis such that the inner annular support member and the outer annular support member may not be concentric with each other, i.e., they do not share the same center. For example, the inner annular support member may be nested within the outer annular support member, but a center of the inner annular support member may be offset from a center of the outer annular support member and thereby non-concentric with the outer annular support member.

In the illustrated embodiment of FIG. 2, the inner annular support member is coplanar with the outer annular support member. For example, the inner annular support member and the outer annular support member are substantially centered about a center axis 172 between a front side 168 and a rear side 170 of the apparatus. In the illustrated embodiment of FIG. 2, the inner annular support member has a size (e.g., width) between the front and rear ends that is less than or smaller than a size (e.g., width) of the outer annular support member between the front and rear sides (e.g., along the inner and outer axes). Alternatively, the inner annular support member may have a size or width that is substantially the same as the size or width of the outer annular support member, or that is greater than the size or width of the outer annular support member. The shape, size, and positioning of the inner annular support member relative to the shape, size, and positioning of the outer annular support member may be determined to control one or more characteristics of a first fluid that moves within the apparatus.

In one or more embodiments, the apparatus may include one or more inner annular support members and/or one or more outer annular support members. For example, in one embodiment, the apparatus may include two inner annular support members and three outer annular support members. One or more of the multiple inner and outer annular support members may be aligned, eccentric, concentric, parallel to one or more other inner or outer annular support members in any combination.

In one or more embodiments, the shape, size, and orientation of the apparatus may be based on a space within a power system in which the thermal management system may be used. For example, the inner and/or outer annular support members may be shaped and sized based on an amount of space available within the power system or equipment (e.g., stationary and/or moving power system). Optionally, the size and/or shape or the apparatus may be based on an amount of the first fluid that moves within the apparatus, based on thermal management requirements of the power system or equipment, based on other regulatory requirements, or the like.

The inner and outer annular support members may be coupled with each other via plural tubes 138, 140 that are coupled with and extend between the inner and outer annular support members. In the illustrated embodiment, each of the plural tubes extends along a curved pathway 134, 136 between the inner and outer annular support members. The curved pathways of the plural tubes are spiral curves along long axes of each of the plural tubes. In one or more embodiments, the curved pathways of one or more of the plural tubes may be in golden spirals, in logarithmic spirals, in approximate golden spirals, non-uniform rational basis spline (NURBS) based curves, freeform curves, curves defined by splines, mathematically represented curves, a combination or two or more therein, or the like. Optionally, the curved pathways of the plural tubes may have a curve with tangent lines at a non-constant angle to the inner and/or outer axes. In one or more embodiments, the plural tubes 138 may have a curved pathway that is a golden spiral, and the plural tubes 140 may have a curved pathway in a logarithmic spiral that is different than the golden spiral. Optionally, the plural tubes 138 that follow the curved pathways 134 may have a shape and/or size that is different than a shape and/or size of the plural tubes 140 that follow the curved pathways 136.

In one or more embodiments, the apparatus may include one or more of the plural tubes that may extends along a linear radial pathway (e.g., a non-curved pathway) between the inner and outer annular support members (not shown). For example, one or more tubes may have a curved pathway (e.g., a golden spiral, logarithmic spiral, or the like), and another tube may extend in a linear or non-curved pathway between the inner and outer annular support members. Optionally, the apparatus may include a first set of plural tubes and a second set of plural tubes. The plural tubes of the first set may each extend in a common curved pathway, and the plural tubes of the second set may extend in a common radial pathway.

In one embodiment, the inner annular support member may have a size that is substantially the same as or greater than a size of the outer annular support member. The inner and outer annular support members may lie on the periphery of a common or different radii. The plural tubes may extend along curved pathways from one support to the other across the circumscribed area defined by the inner and outer annular support members. Optionally, the plural tubes may extend along curved pathways and at locations outside of circumscribed area defined by the inner and outer annular support members.

In one or more embodiments, one or more of the plural tubes may have a first shape and/or first size at a location proximate to the inner annular support member, and a second shape and/or second size at a location proximate to the outer annular support member. For example, the plural tubes may have a circular shape at one end of the plural tubes, and an elliptical shape at a different end of the plural tube. Optionally, the shape and/or size of the tubes may vary at different locations along the length of the plural tubes between the inner and outer annular support members. For example, one or more of the plural tubes may have a substantially circular cross-sectional shape at a location proximate the inner annular support member, the shape may change to an elliptical cross-sectional shape at a first distance away from the inner annular support member, may change to a rectangular cross-sectional shape at a second distance away from the inner annular support member, and may have an oblong cross-sectional shape at a location proximate the outer annular support member. In one embodiment, the plural tubes may have substantially constant, increasing and/or decreasing cross-sectional areas at different locations along the curved pathways of the plural tubes between the support members.

The inner annular support member includes one or more surfaces 130 that define a first interior cavity 132, and the outer annular support member includes plural surfaces 124, 126 that define a second interior cavity 128. Additionally, the plural tubes may include one or more surfaces 150, 152, 154, 156 of the plural tubes that define interior passages 158, 160 of each of the plural tubes. The first cavity of the inner annular support member may be fluidly coupled with one or more of the interior passages of the plural tubes, and the one or more of the interior passages of the plural tubes may be fluidly coupled with the second interior cavity of the outer annular support member. For example, the first interior cavity, the second interior cavity, and the interior passages of the plural tubes may be fluidly coupled with each other. In the illustrated embodiment, each of the plural tubes are fluidly separate from each other. Optionally, in alternative embodiments, two or more of the plural tubes may be fluidly coupled with each other via connecting passages or conduits or structurally coupled via struts, ribs, or other mechanical members that assist in transferring mechanical loads.

The first interior cavity of the inner annular support member may receive the first fluid (e.g., a liquid, a gas, emulsion, a liquid-gas mixture, a dispersed solid in gas and/or liquid, an aerosol, or the like) from the inlet reservoir via a first conduit 110. In one or more embodiments, the first conduit may be referred to as an inlet conduit. The first conduit may be coupled with a flow regulation device (not shown), such as a valve, baffle, louver, or the like, to control the flow of the first fluid into the first interior cavity. In one or more embodiments, the first reservoir may include, or be operably coupled with, a first fluid control device 116. The fluid control device may be and/or include a pump, a blower, a fan, valves, baffles, louvers, or the like, that may promote the movement of the first fluid out of the first reservoir in a first direction 118 and toward the first interior cavity of the inner annular support member via the first conduit. In one or more embodiments, the first fluid may be directed out of the plural tubes and into the first reservoir in a direction opposite the first direction 118. In one or more embodiments, the first interior cavity may be shaped and sized to control one or more characteristics of the first fluid that is received within the first interior cavity, such as a pressure, a velocity, a volume, a volumetric flow rate, an amount of turbulence, a direction of flow, temperature or the like.

The first fluid may move through the first interior cavity of the inner annular support member and into one or more of the plural passages. In one or more embodiments, one or more of the plural passages may have a shape and/or size that is different than a shape and/or size of another plural passage to control characteristics of different portions of the first fluid that is directed into different tubes of the plural tubes. For example, one or more of the plural tubes may be shaped and/or sized to control an amount of the first fluid directed into the tube, a pressure of the portion of the first fluid that is directed into the tube, a flow velocity of the portion of the first fluid, or the like.

In one or more embodiments, the apparatus may include one or more surface features that may change one or more characteristics of the first fluid (e.g., pressure, pressure drops, volumetric flow rates, flow direction, or the like). For example, the surface features may include bumps, baffles, vanes, louvers, divots, fins, or the like, disposed within one or more of the first interior cavity, the second interior cavity, or the interior passages of the plural tubes.

The first fluid may subsequently move out of each of the plural tubes and into the second interior cavity of the outer annular support member. In one or more embodiments, the outer annular support member may have the shape or formation of a scroll or volute, such that the second interior cavity of the outer annular support member may function as a collector volume and may collect the first fluid emanating from the plural tubes.

In the illustrated embodiment, the second interior cavity is fluidly coupled with the second or outlet reservoir via a second or outlet conduit 112. The outlet conduit may be coupled with a flow regulation device (not shown), such as a valve, baffle, louver, or the like, to control the flow of the first fluid out of the second interior cavity. The outlet conduit directs the first fluid out of the second interior cavity in a second direction 122 toward the outlet reservoir. Optionally, the first fluid may move in a direction opposite the second direction and away from the outlet or second reservoir and toward the plural tubes. In one or more embodiments, the outlet conduit may direct the first fluid out of the second interior cavity as an exhaust and out of the thermal management system. Optionally, the first fluid may be directed into the outlet reservoir, where the first fluid may be recycled within the power system or equipment including the thermal management system, directed to another system, or the like. The positioning of the first and second reservoirs relative to the apparatus, and the first and second directions of the first fluid moving out of the first reservoir and into the second reservoir are for illustrative purposes only. In alternative embodiments, the first fluid may be directed in any alternative radial directions into and/or out of the apparatus.

In one or more embodiments, the inner annular support member may have plural first interior cavities. Optionally, the outer annular support member may have plural second interior cavities. In one example, each of the plural first interior cavities of the inner annular support member may be fluidly coupled with the first reservoir. Optionally, each of the plural second interior cavities of the outer annular support member may be fluidly coupled with the outlet reservoir. In one embodiment, the plural first interior cavities may be fluidly separate from each other, and may be manufactured as segmented, separate, or integral structures relative to one or more other first interior cavities. Optionally, the plural second interior cavities may be fluidly separate from each other, and may be manufactured as segmented, separate, or integral structures relative to one or more other second interior cavity.

The curved pathways of the plural tubes may direct different portions of the first fluid in the different spiral directions from the first interior cavity of the inner annular support member toward the second interior cavity of the outer annular support member. In the illustrated embodiment of FIGS. 1 and 2, the apparatus includes a first set 138 of the plural tubes that extend along the curved pathways 134 in a clockwise direction 164 and direct the different portions of the first fluid moving within each of the plural tubes of the first set in the clockwise direction between the inner annular support member and the outer annular support member. The first set of the plural tubes may include any number of tubes such as two tubes, ten tubes, one hundred tubes, one thousand tubes, or the like.

In the illustrated embodiment, the apparatus also includes a second set 140 of the plural tubes that extend along the curved pathways 136 in a counter-clockwise direction 166 and direct the different portions of the first fluid moving within each of the plural tubes of the second set in the counter-clockwise direction between the inner and outer annular support members. The second set of tubes may include the same number of tubes as the first set of tubes, or alternatively may include a different number of tubes. In one or more embodiments, the apparatus may include a single set of plural tubes that direct the different portions of the first fluid in just one direction (e.g., clockwise or counter-clockwise). In another embodiment, the apparatus may include three or more different sets of plural tubes, wherein one or more of the different sets may direct the first fluid in one direction, and one or more other sets of tubes may direct the first fluid in a different direction.

In the illustrated embodiment of FIG. 2, the first set of the plural tubes 138 extend in a first plane 174 and the second set of the plural tubes 140 extend in a second plane 176. Each of the plural tubes of the first set may be coplanar with each other within the first plane. Additionally, each of the plural tubes of the second set may be coplanar with each other within the second plane. The first and second planes are parallel with each other, and are substantially perpendicular to the inner and outer axes of the inner and outer annular support members, respectively. Optionally, the first and second planes may form an angle with each other, may intersect each other between the two fluid interior cavities, may have non-planar definitions, or the like. In one or more embodiments, the apparatus may include additional sets of plural tubes that may extend in planes that are parallel with the first and second planes, that extend in one or more radial directions relative to the first and second planes, or the like. Optionally, the plural tubes may extend and spread over a hemispherical surface, or the like.

In one or more embodiments, one or more portions of the apparatus including the inner and outer annular support members and the plural tubes may be manufactured additively as a single, unitary component. For example, the apparatus may be formed as a unitary structure from a single piece or body. For example, the apparatus may be formed as a homogenous single component, rather than a non-homogenous component or a component formed by two or more separate bodies that are then combined with each other. The homogenous component may have the same consistency and/or chemical makeup throughout the entirety or substantially all of the component.

Optionally, in one or more embodiments, one or more portions of the apparatus may be formed via one or more additive manufacturing methods, and may be coupled with other portions of the apparatus via non-additive manufacturing methods. Additively manufacturing the apparatus of the thermal management system allows for the apparatus to be more compact relative to manufacturing the system using non-additively manufacturing methods, such as extruding, stamping, casting, forging, or the like. Additionally, additively manufacturing the apparatus allows the apparatus to having varying three-dimensional shapes, to have multi-domain cooling techniques (e.g., different cooling channels or conduits), or the like, within the same unitary component. Additive manufacturing can involve joining or solidifying material under computer control to create a three-dimensional object, such as by adding liquid molecules or fusing powder grains with each other. Examples of additive manufacturing include three-dimensional (3D) printing, rapid prototyping (RP), direct digital manufacturing (DDM), selective laser melting (SLM), electron beam melting (EBM), direct metal laser melting (DMLM), direct energy deposition (DED), or the like. Alternatively, the thermal management system, or a portion of the apparatus, can be formed in another manner.

In one or more embodiments, the plural tubes may be separated from each other in an axial direction, for example relative to the inner and outer axes of the inner and outer annular support members. For example, spaces or voids may be disposed between two or more adjacent tubes. The spaces or voids may be sized and positioned to allow movement of a second fluid (e.g., air, gas, a coolant liquid, or the like) to move along exterior surfaces of the plural tubes. For example, the second fluid may exchange thermal energy with the first fluid moving within the apparatus.

In the illustrated embodiment of FIG. 2, the thermal management system includes a third fluid control device 146. In one embodiment, the third fluid control device may be a fan, a blower, or the like, that directs the second fluid (e.g., ambient air, gas, a liquid such as a coolant, or the like) in a third direction 148 toward a rear side 170 of the apparatus. Optionally, the third fluid control device may be disposed on another side of the apparatus such that the third fluid control device may direct the second fluid toward a front side 168 of the apparatus. Additionally or alternatively, the thermal management system may include two or more different fans and/or pumps that may pull and/or push the second fluid toward the front end and away from the rear end of the apparatus, or toward the rear end and away from the front end of the apparatus. In one or more embodiments, the third fluid control device may have a size that is substantially the same as a size of the apparatus such that the third fluid control device may direct the second fluid toward substantially all or a majority of the apparatus. Optionally, the thermal management system may include plural fans, such that one fan directs a first portion of the second fluid toward a first area or first portion of the apparatus, and a second fan directs a second portion of the second fluid toward a second area or second portion of the apparatus.

In one or more embodiments, the first fluid that moves within the apparatus may be a liquid, a gas, a liquid-gas mixture, a liquid or gas carrying a dispersed solid, an emulsion, an aerosol, or another media. Additionally, the second fluid that moves outside of the apparatus may be a liquid, a gas, a liquid-gas mixture, or another media that may be the same or different than the first fluid. For example, the first fluid may be water, and the second fluid may be air. Optionally, the first and second fluids may be any alternative phases of different materials.

The curved pathways of the plural tubes increasing an amount of travel, or distance of the curved pathways between the inner and outer annular support members relative to tubes that extend along non-curved pathways. Additionally, as the first fluid moves along the curved pathways of the tubes, the portions of the first fluid moving within each of the plural tubes may mix with itself, increasing the amount of thermal energy that may be directed out of the portions of the first fluid relative to fluid that moves in a non-curved pathway. The curved pathways also increase a surface area of the plural tubes relative to tubes that extend along non-curved pathways. Increasing the surface area of the plural tubes increases an amount of thermal energy that may be transferred between the first and second fluids.

The first fluid received within the second interior cavity may have an amount of thermal energy that is different than the first fluid that is received within the first interior cavity. For example, the first fluid directed into the first interior cavity may have a temperature that is greater than a temperature of the first fluid directed into the second interior cavity. As the first fluid moves through the apparatus from the first interior cavity, through the plural tubes, and into the second interior cavity, the first fluid may exchange thermal energy with the second fluid moving outside of the apparatus. For example, the second fluid may receive thermal energy from the first fluid such that the second fluid cools the first fluid.

In one or more embodiments, different portions of the apparatus may be manufactured of different or the same materials. As one example, the plural tubes may be manufactured of a first material in order to control an amount of thermal energy that is transferred between the first fluid and the second fluid, to control an amount of thermal energy that is transferred at a location along the linear and/or curved pathways of the plural tubes, or the like. In one or more embodiments, one or more of the plural tubes may be additively manufactured of a first material, and may include a coating disposed along an interior surface of the tube. Optionally, an interior surface of one or more tubes may be a first material, and an exterior surfaces of the one or more tubes may be manufactured of a second material. Optionally, the interior surface of one or more tubes may include a first surface treatment (e.g., hydro-coating, hydro erosion, a smooth finish, or the like), and the exterior surface of the one or more tubes may include a second surface treatment (e.g., a rough surface treatment, or the like). For example, a smooth interior surface of one or more of the tubes may reduce an amount of resistance of the portion of the first fluid moving within the tube relative to a rough or textured interior surface. Additionally, a rough exterior surface of the tube may increase an amount of thermal energy transferred between the first and second fluids relative to a smooth exterior surface.

In one or more embodiments, different portions of the plural tubes may be manufactured of different materials. For example, the plural tubes may be additively manufactured as a homogenous structure or single embodiment via a DED additive manufacturing method. The substrate or a skeleton of the plural tubes may be manufactured of a first material, and the surface or skin of the skeletal structure may be manufactured of a second material. In one embodiment, the first material may be characterized as stronger than the second material. For example, the first material may be steel, or the like, and the second material may be copper, or the like. In one or more embodiments, one or more regions or areas of the plural tubes may receive secondary surface treatments subsequent to the DED additive manufacturing of the plural tubes of the two or more different materials.

Figure 3:
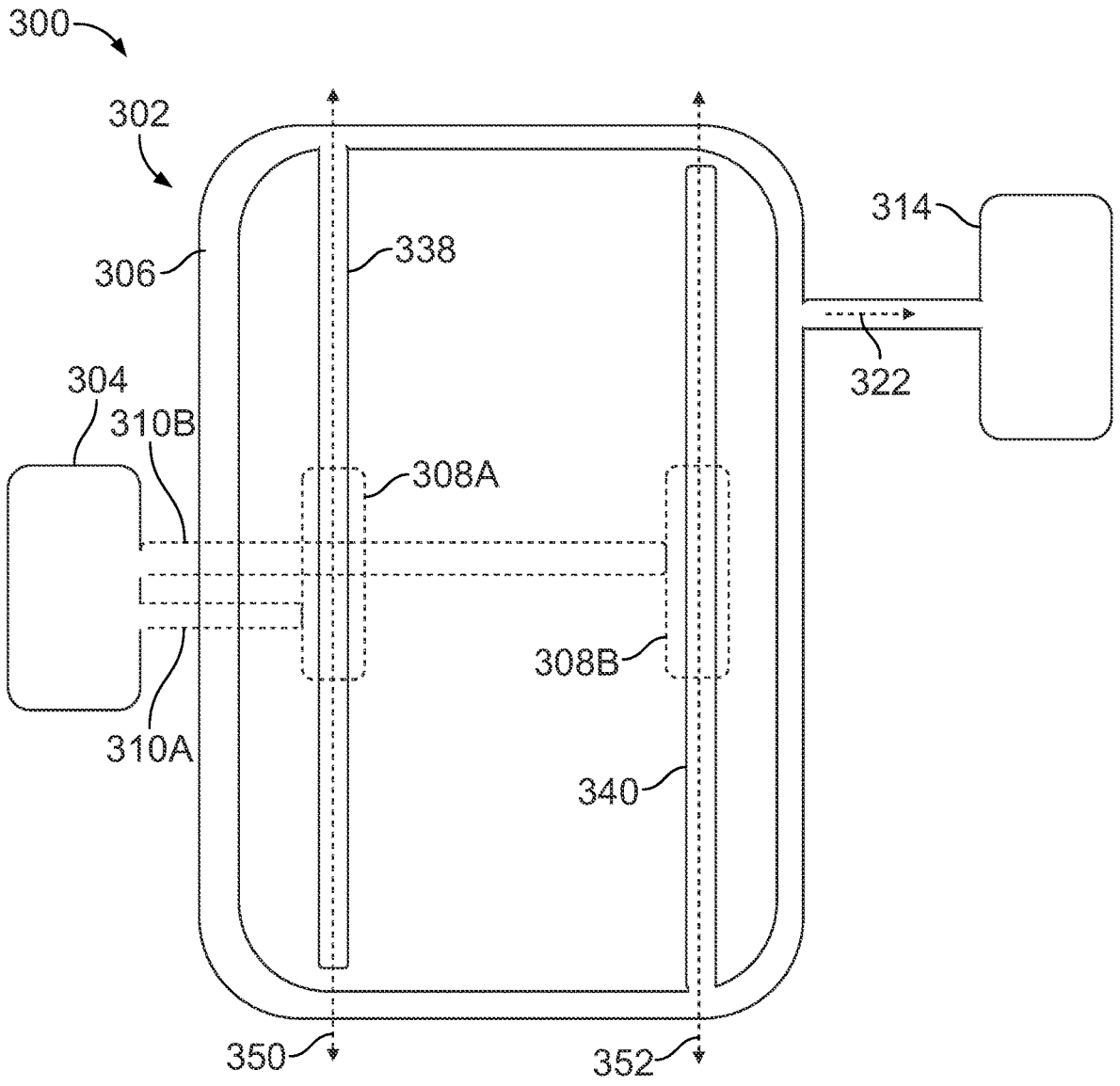
FIG. 3 illustrates a side cross-sectional view of an apparatus of a thermal management system in accordance with one embodiment.

FIG. 3 illustrates a side cross-sectional view of an apparatus 302 of a thermal management system in accordance with one or more embodiments. The thermal management system includes the apparatus that is fluidly coupled with a first reservoir 304 and a second reservoir 314. Optionally, the first reservoir may be referred to herein as an inlet reservoir, and/or the second reservoir may be referred to as an outlet reservoir. In the illustrated embodiment, the apparatus includes an outer annular support member 306, a first inner annular support member 308A, and a second inner annular support member 308B. The first annular support member is fluidly coupled with the first reservoir via a first inlet conduit 310A, and the second annular support member is fluidly coupled with the first reservoir via a second inlet conduit 310B.

In the illustrated embodiment, both of the first and second inner annular support members are nested or disposed within the outer annular support member. Additionally, the first and second annular support members are concentric with each other, and the first and second annular support members are concentric with the outer annular support member. Optionally, one or both of the inner annular support members may be non-concentric with the outer annular support member, with the other inner annular support member, or any combination therein.

The apparatus includes a first set of plural tubes 338 that are coupled with and extend between the first inner annular support member and the outer annular support member. The first set of plural tubes may include more than two tubes, ten tubes, one hundred tubes, one thousand tubes, or the like. In the illustrated embodiment, the apparatus includes a second set of plural tubes 340 that are coupled with an extend between the second inner annular support member and the outer annular support member. The second set of plural tubes may include a same number of tubes as the first set of plural tubes, or a different number of tubes than the first set.

The plural tubes of the first set extend along a first plane 350, and the plural tubes of the second set extend along a second plane 352 that is parallel with the first plane. In one or more embodiments, the apparatus may include more than two sets of plural tubes, and the additional sets of plural tubes may extend along planes that may be substantially parallel with the first and/or second planes, or may extend in radial directions relative to the parallel directions of the first and second planes. Optionally, the first plane may be non-parallel with the second plane, the first and second planes may intersect with each other, the planes may form an angle with each other, or the like.

Figure 4:
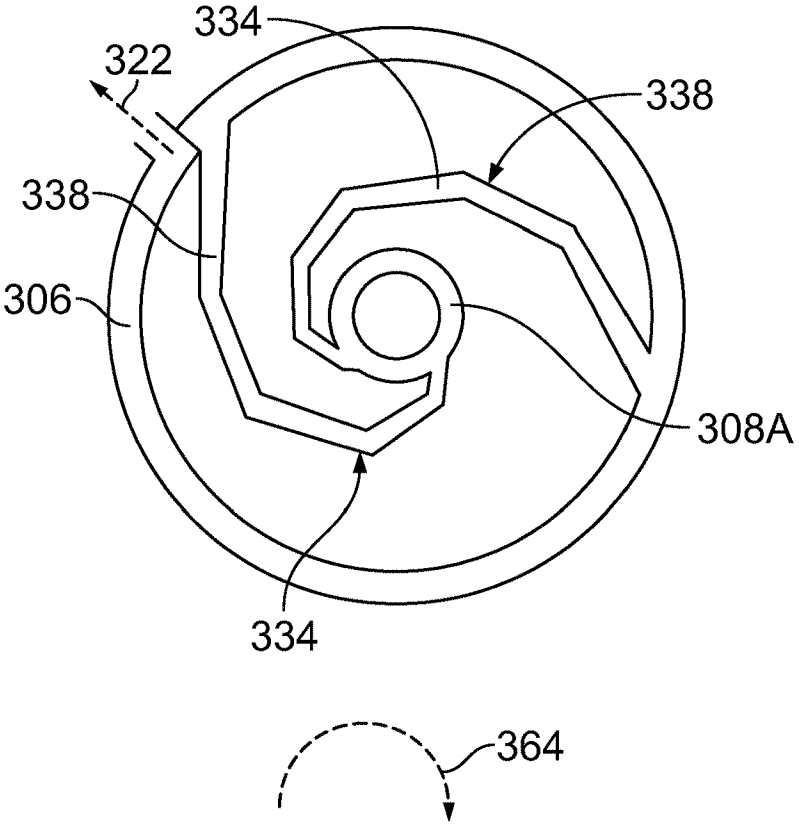
FIG. 4 illustrates a front cross-sectional view of a first plane of the apparatus shown in FIG. 3.

FIG. 4 illustrates a front view of the first plane of the apparatus shown in FIG. 3. The first set of plural tubes extend along curved pathways 334 between the first inner annular support member and the outer annular support member. The curved pathways of the first set of plural tubes may follow a golden spiral curve, a logarithmic spiral curve, an approximate golden spiral curve, a non-uniform rational basis spline (NURBS) based curve, a freeform curve, a curve defined by splines, a mathematically represented curve, or the like. The first inner annular support member is fluidly coupled with the outer annular support member via the first set of plural tubes. The first set of the plural tubes are positioned to direct a first fluid to move from the first inner annular support member toward the outer annular support member in a clockwise direction 364.

Figure 5:
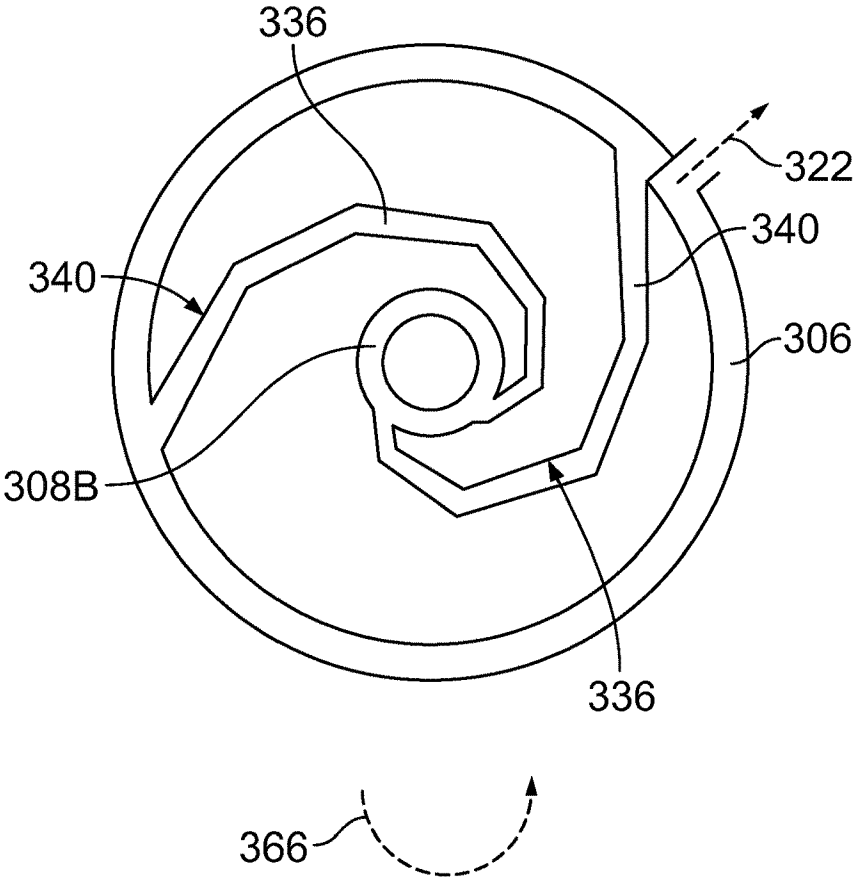
FIG. 5 illustrates a front cross-sectional view of a second plane of the apparatus shown in FIG. 3.

FIG. 5 illustrates a front view of the second plane of the apparatus shown in FIG. 3. The second set of the plural tubes extend along curved pathways 336 between the second inner annular support member and the outer annular support member. The second inner annular support member is fluidly coupled with the outer annular support member via the second set of the plural tubes. The second set of the plural tubes are positioned to direct the first fluid to move from the second inner annular support member toward the outer annular support member in a counter-clockwise direction 366. Optionally, one of the plural tubes of the second set may be positioned to direct the first fluid in the counter-clockwise direction, and one or more tubes of the second set may be positioned to direct the first fluid in the clockwise direction.

In the illustrated embodiments of FIGS. 4 and 5, the curved pathways of the first set and the second set of the plural tubes extend in substantially the same or uniform spiral curves. Optionally, the first set of the plural tubes may be positioned to follow a golden spiral curve, and the second set of the plural tubes may be positioned to follow a logarithmic spiral curve that is different than the golden spiral curve.

In one or more embodiments, the apparatus may include multiple sets of tubes. For example, the apparatus may include a single set of plural tubes or more than two sets of plural tubes, as illustrated in FIGS. 4 and 5. The multiple sets of plural tubes may extend along curved pathways along substantially the same or unique spiral curves relative to the plural tubes of the other sets of the plural tubes. In one embodiment, the apparatus may include plural inner annular support members and plural outer annular support members, and multiple sets of plural tubes. For example, a first set of plural tubes may extend between a first inner annular support member and a first outer annular support member; a second set of plural tubes may extend between the first inner annular support member and a second outer annular support member; a third set of plural tubes may extend between a second inner annular support member and the first outer annular support member; and a fourth set of plural tubes may extend between the second inner annular support member and the second outer annular support member. Optionally, the apparatus may have any alternative configuration.

Figure 6:
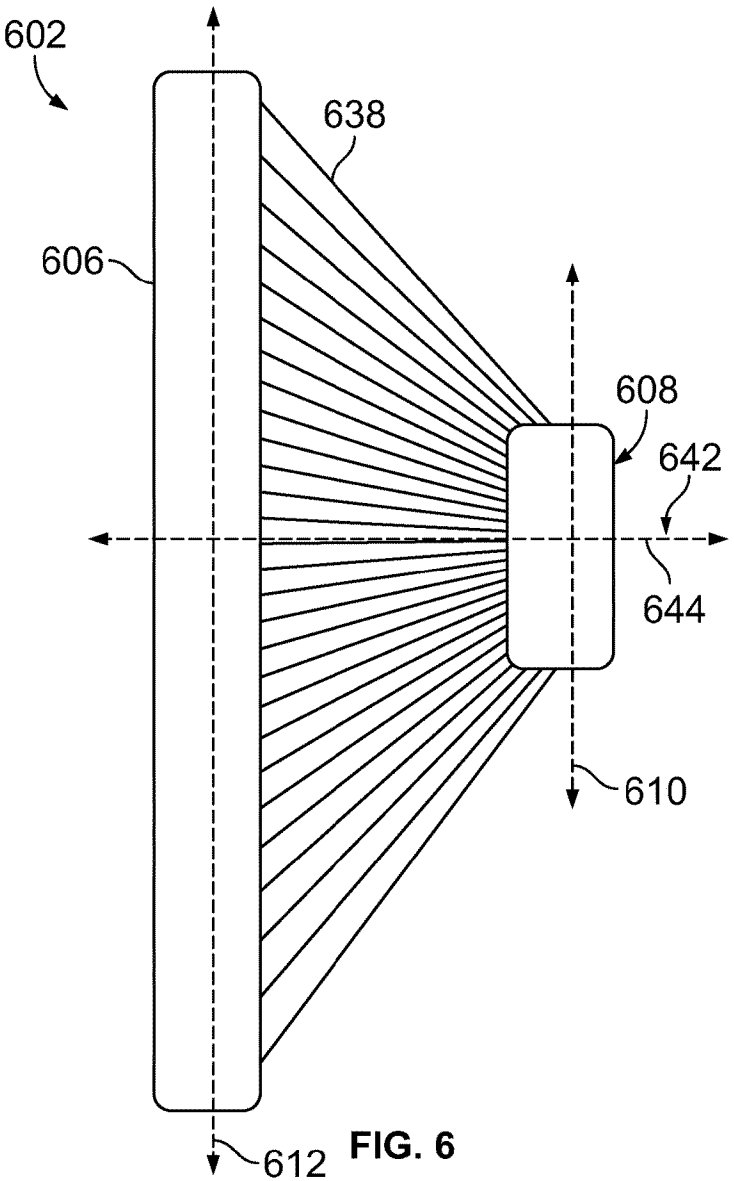
FIG. 6 illustrates a side view of an apparatus of a thermal management system in accordance with one embodiment.

FIG. 6 illustrates a side view of an apparatus 602 of a thermal management system in accordance with one embodiment. The apparatus includes an inner annular support member 608 and an outer annular support member 606, and plural tubes 638 that extend between the inner and outer annular support members. The inner annular support member is nested within the outer annular support member such that the inner annular support member is positioned within an area defined by the outer annular support member in at least one direction.

In the illustrated embodiment, the apparatus includes only a first set of plural tubes that may extend along curved pathways between the inner and outer annular support members. Optionally, the apparatus may include plural sets of plural tubes that may extend between the inner and outer annular support members. The different sets of the plural tubes may be nested within each other between the inner and outer annular support members, and may be positioned to direct portions of the first fluid in clockwise and/or counter-clockwise directions.

In the illustrated embodiment, the inner annular support member extends about an inner axis 642, and the outer annular support member extends about an outer axis 644. In the illustrated embodiment, the inner and outer axes are aligned with each other such that the inner annular support member and the outer annular support member are concentric with each other. Optionally, the inner and outer annular support members may be non-concentric with each other.

The inner annular support member extends along a first plane 610 in a direction that is substantially perpendicular with the inner axis, and the outer annular support member extends along a second plane 612 in a direction that is substantially perpendicular with the outer axis. The first plane and the second plane of the inner and outer annular support members, respectively, are parallel with each other. Optionally, one of the support members may extend along different planes that may be non-parallel with the plane of the other support member. For example, the inner annular support member may extend in a direction that is radially offset relative to the outer annular support member. Additionally, the first plane is offset from the second plane along the inner and outer axes such that the inner annular support member is non-coplanar with the outer annular support member. In one or more embodiments, the plural tubes may extend along a third plane. The third plane of the plural tubes may be a conical section, may follow a paraboloid surface or a hemispherical surface over which axes of the tubes are aligned, or the like.

Figure 7:
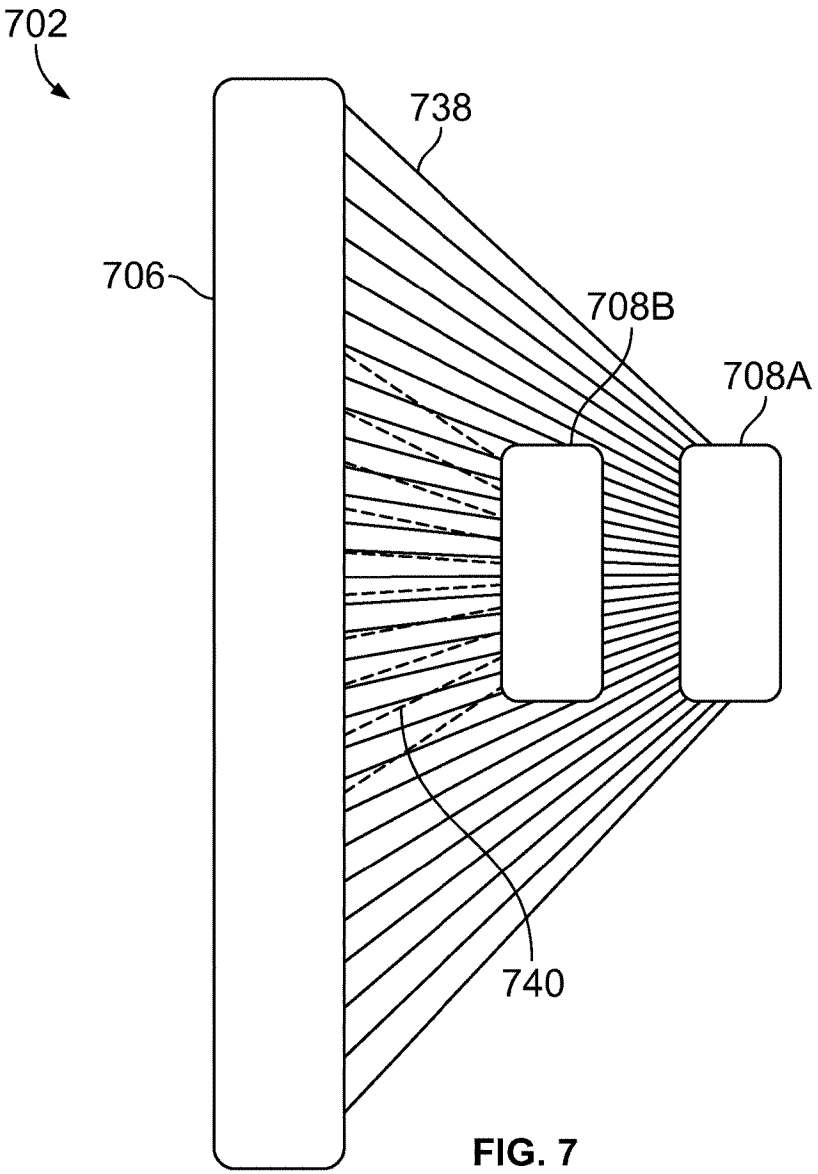
FIG. 7 illustrates a side view of an apparatus of a thermal management system in accordance with one embodiment.

FIG. 7 illustrates a side view of an apparatus 702 of a thermal management system in accordance with another embodiment. The apparatus includes a first inner annular support member 708A, a second inner annular support member 708B, and an outer annular support member 706. Optionally, the apparatus may include multiple outer annular support members that may be fluidly coupled and/or separate with each other. The multiple outer annular support members may be nested one inside of another, may be aligned and/or off-set in a radial direction, may be positioned adjacent to each other in an axial direction with or without a radial offset (e.g., in the peripheral, and/or circumferential direction), or the like. In one embodiment, the apparatus may include the first and second inner annular support members, and each of the first and second inner annular support members may be fluidly coupled with two or more different outer annular support members. Optionally, the apparatus may have an alternative configuration.

In the illustrated embodiment of FIG. 7, the first and second inner annular support members are nested within the outer annular support member such that the first and second inner annular support members are positioned within an area defined by the outer annular support member in at least one direction. Like the apparatus shown in FIG. 6, the first and second inner annular support members are concentric with each other, and with the outer annular support member. Additionally, the first inner annular support member is non-coplanar with the second inner annular support member, and both of the first and second inner annular support members are non-coplanar with the outer annular support member. Alternatively, the first inner annular support member may be non-coplanar with the outer annular support member, but the second inner annular support member may be coplanar with the outer annular support member. Optionally, the apparatus may have an alternative configuration.

The apparatus may include a first set of plural tubes 738 that extend between the first inner annular support member and the outer annular support member, and a second set of plural tubes 740 that extend between the second inner annular support member and the outer annular support member. In one or more embodiments, the first set of the plural tubes may extend along curved pathways to direct portions of the first fluid in one of a clockwise or counter-clockwise direction, and the second set of the plural tubes may extend along curved pathways to direct portions of the first fluid in the other of the clockwise or counter-clockwise direction. For example, the first set of tubes may direct portions of the first fluid in one direction, and the second set of tubes may direct portions of the first fluid in a different direction.

Figure 8:
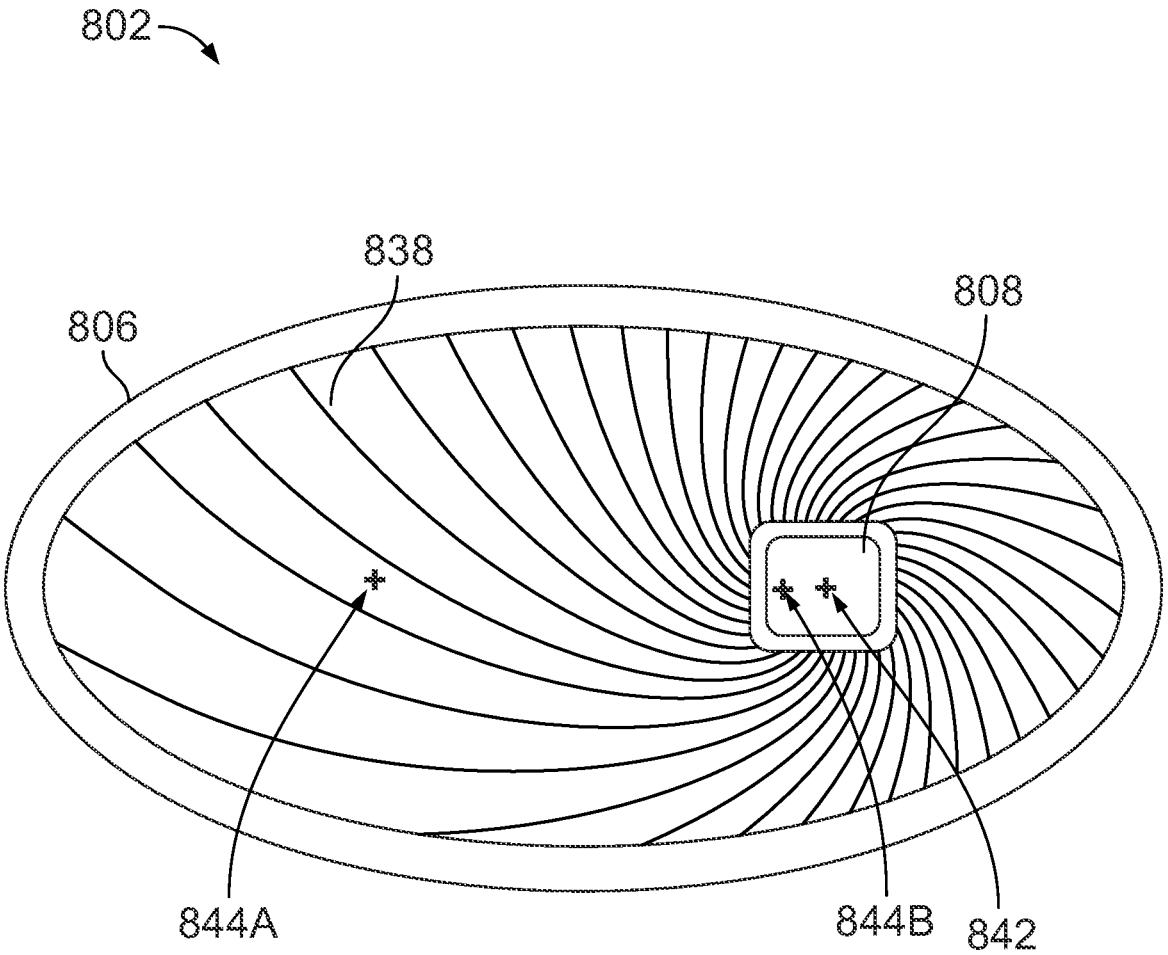
FIG. 8 illustrates a front view of an apparatus of a thermal management system in accordance with one embodiment.

FIG. 8 illustrates an apparatus 802 of a thermal management system in accordance with one embodiment. Like the apparatus shown in FIG. 1, the apparatus includes an inner annular support member 808, an outer annular support member 806, and plural tubes 838 that extend along curved pathways between the inner and outer annular support members. Optionally, the apparatus may include two or more inner annular support members, two or more outer annular support members, and multiple sets of tubes extending between the inner and outer annular support members in any combination. The inner annular support member is nested within the outer annular support member such that the inner annular support member is positioned within an area defined by the outer annular support member in at least one direction.

In the illustrated embodiment, the inner annular support member extends about an inner axis 842, and the outer annular support has a substantially elliptical shape defined by two axes 844A, 844B (e.g., foci of the ellipse). The inner axis is offset from the outer axis such that the inner annular support member is non-concentric with the outer annular support member. Additionally, the inner annular support member has a substantially rectangular cross-sectional shape, and the outer annular support member has the substantially elliptical or oval cross-sectional shape. Optionally, the inner annular support member may have an alternative cross-sectional shape, and the cross-sectional shape of the inner annular support member may be substantially the same as or different than the cross-sectional shape of the outer annular support member.

Figure 9:
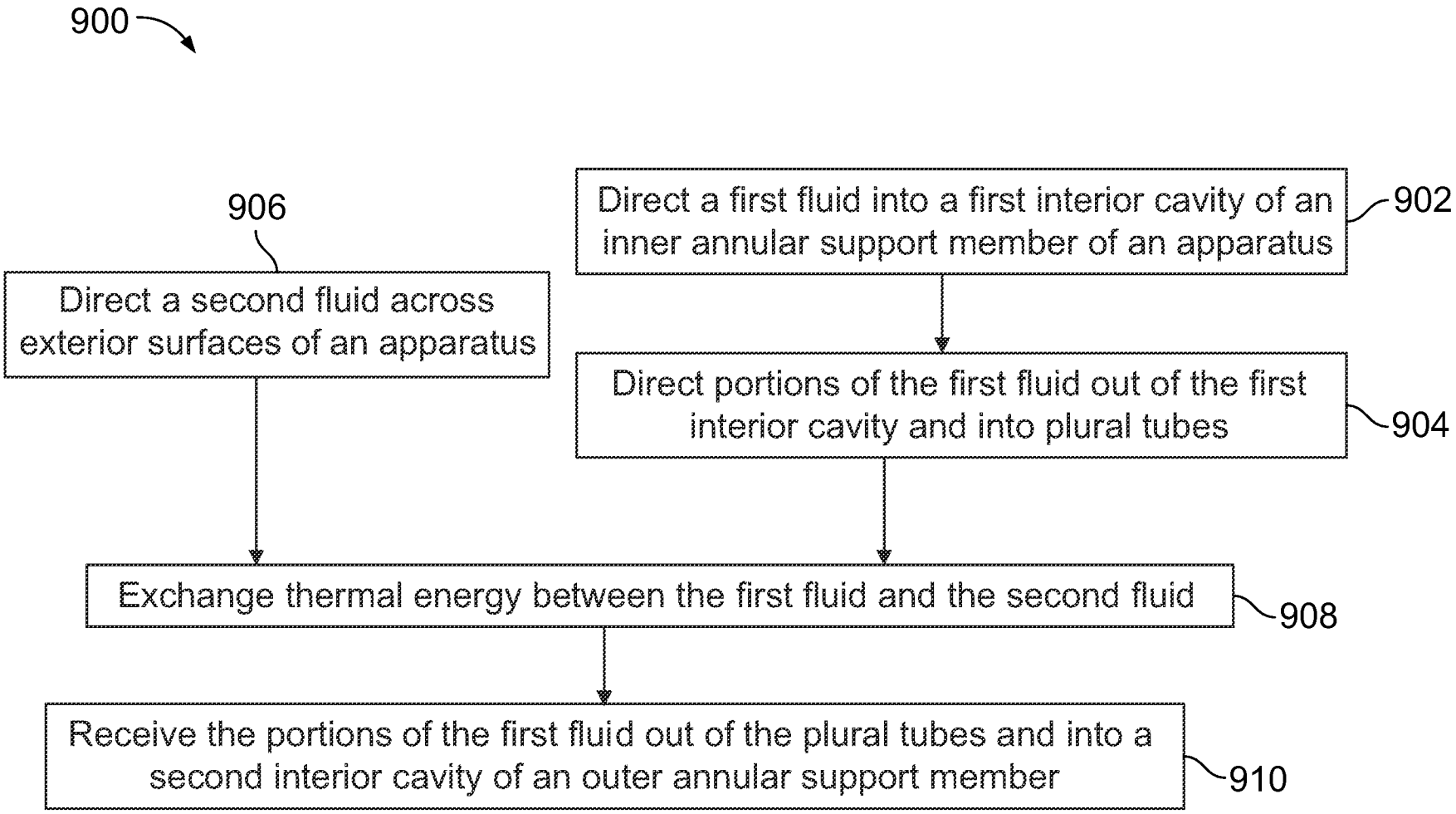
FIG. 9 illustrates a method of controlling fluids within a thermal management system in accordance with one embodiment.

FIG. 9 illustrates a flowchart 900 of a method for controlling fluids within a thermal management system in accordance with one embodiment. At step 902, a first fluid may be directed into a first interior cavity of an inner annular support member of an apparatus. The first fluid may be received from a first reservoir (e.g., an inlet reservoir) that may be a part of a power system or equipment that includes the apparatus of a thermal management system. At step 904, portions of the first fluid may be directed to move from the first interior cavity and through interior passages of plural tubes coupled with the inner annular support member. The plural tubes may extend along curved pathways between the inner annular support member and an outer annular support member of the apparatus. The curved pathways of the plural tubes may be in golden spiral pathways, logarithmic spiral pathways, approximate golden spiral curves, non-uniform rational basis spline (NURBS) based curves, freeform curves, curves defined by splines, mathematically represented curves or the like. The plural tubes may be positioned to direct the portions of the fluid in the clockwise direction or the counter-clockwise direction out of the first interior cavity.

At step 906, a second fluid may be directed across one or more exterior surfaces of the apparatus, such as exterior surfaces of one or more of the plural tubes, surfaces of the inner annular support member, surfaces of the outer annular support member, or the like. The second fluid may be promoted to move across the exterior surfaces by a fluid control device, such as a fan, a blower, a pump, or the like. The first and second fluids may be the same or different phases of the same or similar fluids, or may be different fluids. For example, the first fluid may be compressed air, and the second fluid may be a liquid coolant.

At step 908, as the first fluid moves along the curved pathways of the plural tubes, and the second fluid moves across the exterior surfaces of the apparatus, the first and second fluid may exchange thermal energy with each other. For example, the first fluid may have a temperature that is greater than the second fluid, and the second fluid may be used to cool or reduce the temperature of the first fluid moving within the apparatus. At step 910, the portions of the first fluid moving within the plural tubes may be received within a second interior cavity of the outer annular support member. The first fluid may be directed out of the second interior cavity toward an outlet reservoir, may be directed out of the system as an exhaust, stored in separated fluid zones, or the like.

As explained above, an inner annular support member may be nested within an outer annular support member such that the inner annular support member is positioned within an area defined by the outer annular support member in at least one direction. In one embodiment, the inner annular support member and the outer annular support member are co-planar, such that the inner annular support member is located on a same plane as the outer annular support member and within an area of that plane bounded by the outer annular support member. In another embodiment, the inner annular support member and the outer annular support member are non-coplanar. However, the inner annular support member is still positioned within an area defined by the outer annular support member in the sense that a projection of the inner annular support member (i.e., a mathematical projection) along a center axis of the inner annular support member and extending to the plane of the outer annular support member lies within an area of that plane bounded by the outer annular support member.

FIG. 10 illustrates a perspective view of a thermal management system 1000 in accordance with one embodiment. The thermal management system includes an apparatus 1002 that is operably and fluidly coupled with a first reservoir 1010 and a second reservoir 1012. FIG. 11 illustrates a front view of a first cross-sectional plane the apparatus. FIG. 12 illustrates the front view of the first cross-sectional plane shown in FIG. 11. FIG. 13 illustrates the front view of a second cross-sectional plane of the apparatus. FIGS. 10 through 13 will be discussed together herein. The system and the X-Y-Z coordinate system are used herein only for the purpose of explaining aspects of the subject matter and are not intended to limit the scope of the disclosure. In this regard, directional indicators such as "left" and "right," "front" and "back," and "top" and "bottom" are only used to indicate the relative positioning of two sides of the system along the X-direction, the Y-direction, and the Z-direction, respectively.

The system includes the apparatus 1002 that is fluidly coupled with the first reservoir via a first conduit 1014. The apparatus is also fluidly coupled with the second reservoir via a second conduit 1016. In one or more embodiments, the system may include two or more reservoirs that may direct one or more different fluids into and/or out of the apparatus. In one embodiment, a first fluid 1038 may be directed into the apparatus from the first reservoir, and the second reservoir may receive the first fluid that is directed out of the apparatus after the first fluid moves through the apparatus. In another embodiment, the first fluid may be directed into the apparatus from the second reservoir, and the first reservoir may receive the first fluid from the apparatus after the first fluid moves through the apparatus. In one or more embodiments, the outer annular support member may have the shape or formation of a scroll or volute (e.g., a volute conduit 1058 as illustrated in FIG. 11), such that an interior cavity of the outer annular support member may function as a collector volume and may collect the first fluid emanating from the plural tubes.

In one or more embodiments, the system may include one or more first fluid control devices 1056A, 1056B. The first fluid control device(s) may be coupled with, disposed therein, positioned proximate to, or the like, the first and/or second reservoirs. The first fluid control device(s) may be and/or include a pump, a blower, a fan, valves, baffles, louvers, or the like, that may promote the movement of the first fluid out of one of the first or second reservoirs and toward the apparatus, through the apparatus, and toward the other of the first or second reservoir.

The apparatus may include an outer annular support member 1006 and an inner annular support member 1008. The inner annular support member extends about an inner axis 1026, and the outer annular support member extends about an outer axis 1024. In the illustrated embodiment, the inner axis is aligned with the outer axis such that the inner annular support member is concentric with the outer annular support member, i.e. they share the same center. Alternatively, the inner axis may be misaligned with the outer axis such that the inner annular support member and the outer annular support member may not be concentric with each other, i.e., they do not share the same center. For example, the inner annular support member may be nested within the outer annular support member, but a center of the inner annular support member may be offset from a center of the outer annular support member and thereby non-concentric with the outer annular support member. In one or more embodiments, the inner annular support member may be eccentric with the outer annular support member in one or more of an axial direction, a planar direction, or the like.

In the illustrated embodiment, the inner annular support member is nested within the outer annular support member. For example, the inner annular support member is positioned within an area defined by the outer annular support member. Additionally, the inner annular support member has a size that is smaller than the outer annular support member. In the illustrated embodiment, the outer annular support member has a circular shape, and the inner annular support member has a circular shape that is substantially the same as the circular shape of the outer annular support member. Optionally, the inner and/or outer annular support members may have an alternative shape, such as an oval, oblong, toroidal, dumbbell, square, or rectangular shape. Optionally, the inner annular support member may have a shape that differs from the shape of the outer annular support member.

In another embodiment, the inner annular support member may have a size that is substantially the same as a size of the outer annular support member. For example, the inner and outer annular support members may be positioned or lie on a periphery of a defined radius. In another embodiment, the inner annular support member may have a size that is greater than a size of the outer annular support member. For example, the inner annular support member may lie on a defined radius that is greater than a defined radius of the outer annular support member.

In the illustrated embodiment, the inner annular support member is coplanar with the outer annular support member. For example, the inner annular support member and the outer annular support member are substantially centered about a center axis 1004 between a first side (e.g., a front side) 1072 and a second side (e.g., a rear side) 1074 of the apparatus in an axial direction 1032. In the illustrated embodiment, the inner annular support member has a size (e.g., width) between the front and rear sides (in the axial direction) that is substantially the same as a size of the outer annular support member between the front and rear sides. Alternatively, the inner annular support member may have a size or width that is less than the size or width of the outer annular support member, or that is greater than the size or width of the outer annular support member. The shape, size, and positioning of the inner annular support member relative to the shape, size, and positioning of the outer annular support member may be determined to control one or more characteristics of a first fluid that moves within the apparatus.

In one or more embodiments, the apparatus may include one or more inner annular support members and/or one or more outer annular support members. For example, in one embodiment, the apparatus may include two inner annular support members and three outer annular support members. One or more of the multiple inner and outer annular support members may be aligned, eccentric, concentric, parallel to one or more other inner or outer annular support members in any combination.

In one or more embodiments, the shape, size, and orientation of the apparatus may be based on a space within a power system in which the thermal management system may be used. For example, the inner and/or outer annular support members may be shaped and sized based on an amount of space available within the power system or equipment (e.g., stationary and/or moving power system). Optionally, the size and/or shape or the apparatus may be based on an amount of the first fluid that moves within the apparatus, based on thermal management requirements of the power system or equipment, based on other regulatory requirements, or the like. In one or more embodiments, the inner annular support member may have a varying cross-sectional shape and/or size along the inner axis of the inner annular support member. For example, the inner annular support member may have a varying radii along the inner axis to control characteristics of the first fluid moving within the inner annular support member.

The inner and outer annular support members may be coupled with each other via plural tubes 1042-1054 that are coupled with and extend between the inner and outer annular support members. Each of the plural tubes extends from a first end 1028 coupled with an exterior surface 1022 of the inner annular support member and a second end 1030 coupled with an interior surface 1018 of the outer annular support member. In the illustrated embodiment, the tubes have substantially circular cross-sectional shapes, but alternatively may have any alternative shape, may have varying shapes between the first and second ends, or any combination therein.

In the illustrated embodiment, the plural tubes are arranged in plural sets 1040A-D of plural tubes. For example, a first set 1040A may include the plural tubes 1042A-1054A, a second set 1040B may include the plural tubes 1042B-1054B, a third set 1040C may include the tubes 1042C-1054C, and a fourth set 1040D may include the tubes 1042D-1054D. In the illustrated embodiment, each set may include the same number of tubes (e.g., seven tubes are included in each set). Optionally, the apparatus may include more or less than four sets of tubes, and one or more sets may include more or less tubes than one or more other sets of tubes.

The plural tubes are arranged in a circumferential direction 1034 such that the tubes extend radially between the inner and outer annular support members about the circumferential direction. For example, the tubes extend radially from the inner annular support member about a circumference of the inner annular support member between the first and second ends. In the illustrated embodiment, each tube radially extends along a substantially linear pathway between the inner and outer annular support members.

The plural tubes of each set extend along different radial pathways between the inner and outer annular support members relative to each other tube of the set based on the first and second ends of the tubes being axially and circumferentially offset. For example, the first tube of the first set extends along a first pathway between the first and second ends of the first tube, and the second tube of the first set extends along a different, second pathway between the first and second ends of the second tube. The first and second pathways may be linear pathways, as illustrated in FIG. 10.

Optionally, the first and/or the second pathways may be curved pathways between the inner and outer annular support member. For example, one or more of the tubes may extend along curved pathways (e.g., golden spirals, in logarithmic spirals, in approximate golden spirals, non-uniform rational basis spline (NURBS) based curves, freeform curves, curves defined by splines, mathematically represented curves, a combination or two or more therein, or the like) between the first and second ends from the inner annular support member to the outer annular support member. Optionally, the curved pathways of the plural tubes may have a curve with tangent lines at a non-constant angle to the center axis of the apparatus. For example, FIG. 16 illustrates a partial side cross-sectional view of an apparatus 1602 in accordance with one embodiment. The apparatus may include the inner and outer annular support members, and plural tubes 1642-1654 that are disposed at different axial positions in the axial direction 1032 between the front and rear sides of the apparatus. In the illustrated embodiment, each of the plural tubes extends along curved pathways between the first ends coupled with the exterior surface of the inner annular support member and the interior surface of the outer annular support member. Optionally, the tubes may extend along different curved pathways. For example, FIG. 17 illustrates a partial front cross-sectional view of an apparatus 1702 in accordance with one embodiment. The apparatus may include the inner and outer annular support members, and plural tubes 1742-1754 that are disposed at different circumferential positions in the circumferential direction 1034 about the perimeter of the inner annular support member. In the illustrated embodiment, each of the plural tubes extends along curved pathways between the first ends coupled with the inner annular support member and the second ends coupled with the outer annular support member. Optionally, one or more of the tubes may extend along curved pathways that may include a curve, spiral, or the like, in one or more different directions.

In one or more embodiments, one or more of the tubes, or one or more layers of tubes may have common or different projections into the axial direction (e.g., parabolic, circular, elliptical, spline based, double curved, or the like). For example, the apparatus may include plural layers of planes of tubes positioned in different axial planes in the axial direction (e.g., along the center axis of the apparatus). In one embodiment, the plural tubes within a first layer of plural tubes (e.g., in a first axial plane) may have substantially the same circular projections between the inner and outer annular support members, and the plural tubes within a second layer of plural tubes (e.g., in a second axial plane) may have substantially the same elliptical projections between the inner and outer annular support members. Optionally, the plural tubes in the first plane may have substantially the same elliptical projections as the plural tubes in the second plane. Optionally, the plural tubes in the first plane may have elliptical projections that are opposite elliptical projections of the plural tubes in the second plane. Optionally, the tubes of the apparatus may have any alternative spiral arrangement.

Returning to FIGS. 10-13, in one or more embodiments, the apparatus may include one or more support structures 1060-1068 operably coupled with and extending between the plural tubes. In the illustrated embodiment, the support structures extend in the circumferential direction between the plural tubes. In the illustrated embodiment, the support structures are concentric with each other support structure and the inner and outer annular support members about the center axis of the apparatus. Optionally, one or more of the support structures may be non-concentric with the other support structures, or the like. The plural support structures may be arranged in groups of support structures. Additionally, each support structure of a first group may be coupled with and extend between the first tubes of each set of the plural sets of the tubes. For example, a first group of the support structures 1060A, 1062A, 1064A, 1066A, and 1066A are coupled with and extend between the first tubes 1042A-D of each set of tubes, and a second group of the support structures 1060B, 1062B, 1064B, 1066B, and 1068B are coupled with and extend between the second tubes 1044A-D of each set of tubes. The support structures of the first group may be axially aligned with each other in the axial direction. Additionally, the support structures of the first group may be offset from each other in a radial direction away between the inner and outer annular support members.

The support structures may be mechanically fastened to exterior surfaces of the plural tubes, such as by welding, fastening, adhesion, or the like. Optionally, one or more of the support structures may be continuous support structures, such that a single, unitary circular or ring-link structure, which may be welded or otherwise fastened to a surface of each of the plural tubes. Optionally, one or more of the support structures may be formed as plural separate components having a first end that is coupled with a first tube, and a second end that is coupled with a second tube. The plural separate components may be arranged to form a ring-like shape extending between each of the plural tubes.

The plural tubes of each set are arranged such that the tubes are offset from each other in the circumferential direction. For example, in the illustrated embodiment of FIG. 12, the first tube 1042A of the first set extends in a first radial direction between the inner and outer annular support members relative to a vertical axis 1070. Additionally, in the illustrated embodiment of FIG. 13, the second tube 1044A of the first set extends in a second radial direction between the inner and outer annular support members relative to the vertical axis. For example, the first end of the first tube is circumferentially offset from the first end of the second tube, and the second end of the first tube is circumferentially offset from the second end of the second tube.

Additionally, the plural tubes of each set are arranged such that the tubes are offset from each other in the axial direction. For example, FIG. 14 illustrates a side partial cross-sectional view of the apparatus shown in FIG. 10. In the illustrated embodiment, each of the seven tubes of the first set extend between the first and second ends of the tubes. The first end of each tube is coupled with the exterior surface of the inner annular support member, and the second end of each tube is coupled with the interior surface of the outer annular support member. The tubes are separated or spaced apart from each other in the axial direction between the front and rear sides of the apparatus.

FIG. 15 illustrates a top partial cross-sectional view of the apparatus shown in FIG. 10. The plural tubes of each of the first, second, and third sets of tubes (1040A-C) are positioned relative to each other in the circumferential and axial directions, and between the front and rear sides of the apparatus. In the illustrated embodiment, the plural tubes of each set are axially and circumferentially offset from each other in the axial and circumferential directions, respectively. For example, the first tube 1042A of the first set 1040A is offset from the second, third, fourth, fifth, sixth, and seventh tubes 1044A-1054A of the first set in the axial direction (e.g., between the front and rear sides), and in the circumferential direction (e.g., about the circumference of the inner annular support member). For example, the plural tubes of the first set are disposed in plural different axial planes (e.g., that extend perpendicular to the center axis of the apparatus) relative to each other, and plural different circumferential planes (e.g., that extend parallel to the center axis of the apparatus) relative to each other.

Additionally, each tube of each set is axially aligned with each other corresponding tube of the other sets of plural tubes (e.g. in the axial direction 1032). For example, each tube of each set is positioned in a same of common axial plane as each other corresponding tube of the other sets (e.g., are disposed substantially the same distance away from the front side and/or the rear side of the apparatus). For example, the first tube 1042A of the first set is axially aligned with the first tubes 1042B, 1042C, and 1042D of the second, third, and fourth sets, respectively; the second tube 1044A of the first set is axially aligned with the second tubes 1044B, 1044C, and 1044D of the second, third, and fourth sets, respectively; the third tube 1046A of the first set is axially aligned with the third tubes 1046B, 1046C, and 1046D of the second, third, and fourth sets, respectively; the fourth tube 1048A of the first set is axially aligned with the fourth tubes 1048B, 1048C, and 1048D of the second, third, and fourth sets, respectively; the fifth tube 1050A of the first set is axially aligned with the fifth tubes 1050B, 1050C, and 1050D of the second, third, and fourth sets, respectively; the sixth tube 1052A of the first set is axially aligned with the sixth tubes 1052B, 1052C, and 1052D of the second, third, and fourth sets, respectively; and the seventh tube 1054A of the first set is axially aligned with the seventh tubes 1054B, 1054C, and 1054D of the second, third, and fourth sets, respectively.

In the illustrated embodiment, the first tube of each set are circumferentially offset from each other first tube of the other sets (e.g., in the circumferential direction 1034). For example, a first end of the first tube 1042A of the first set is disposed at a first circumferential position about the exterior surface of the inner annular support member; and the first tube 1042B of the second set is disposed at a second circumferential position about the exterior surface of the inner annular support member. Additionally, the first tube of the first and second set are disposed in a common axial plane (e.g., the common axial plane extending perpendicular to the center axis of the apparatus). For example, the first tubes of each set are disposed in the common axial plane relative to each other, but at different circumferential positions (e.g., in different circumferential planes) along the common axial plane.

The inner and outer annular support members are fluidly coupled with the plural tubes such that the first fluid is directed into one of the annular support members and moves through the plural tubes toward the other annular support member. The exterior surface of the inner annular support member defines an interior cavity (e.g., a first interior cavity) of the inner annular support member; and the interior surface and an exterior surface 1020 of the outer annular support member define an interior cavity (e.g., a second interior cavity) of the outer annular support member. Additionally, each of the plural tubes include one or more surfaces 1082, 1084 (illustrated in FIG. 14) that define interior passages 1080 of the plural tubes. The interior cavities of the inner and outer annular support members are fluidly coupled with the interior passages of the plural tubes. In the illustrated embodiments, each of the plural tubes are fluidly separate from each other. Optionally, in alternative embodiments, two or more of the plural tubes may be fluidly coupled with each other via connecting passages or conduits or structurally coupled via struts, ribs, or other mechanical members that assist in transferring mechanical loads.

While the apparatus is in use, one of the interior cavities of the inner or outer annular support member may receive the first fluid from the first or second reservoir, respectively. Suitable fluids may be a liquid, a gas, emulsion, a liquid-gas mixture, a solution, a dispersed solid in gas and/or liquid, an aerosol, or the like. The first or second conduit may be coupled with or include a flow regulation device (not shown), such as a valve, baffle, louver, or the like, to control the flow of the first fluid into the interior cavity of the inner or outer annular support member. In one or more embodiments, the interior cavities may be shaped and sized to control one or more characteristics of the first fluid that is received within the interior cavity, such as a pressure, a velocity, a volume, a volumetric flow rate, an amount of turbulence, a direction of flow, temperature or the like.

The first fluid may flow through the interior cavity of one of the annular support members and into one or more of the plural passages of the plural tubes. In one or more embodiments, one or more of the plural passages may have a shape and/or size that is different than a shape and/or size of another plural passage to control characteristics of different portions of the first fluid that is directed into different tubes of the plural tubes. For example, one or more of the plural tubes may be shaped and/or sized to control an amount of the first fluid directed into the tube, a pressure of the portion of the first fluid that is directed into the tube, a flow velocity of the portion of the first fluid, or the like.

In one or more embodiments, the apparatus may include one or more surface features that may change one or more characteristics of the first fluid (e.g., pressure, pressure drop, volumetric flow rate, flow direction, flow characteristics (surface turbulence, e.g.), and the like). For example, the surface features may include bumps, baffles, vanes, louvers, divots, fins, or the like, disposed within one or more of the interior cavities, or the interior passages of the plural tubes.

The first fluid may subsequently flow or move out of each of the plural tubes and into the interior cavity of the other of the inner or outer annular support member. In one or more embodiments, the inner and/or outer annular support members may have the shape or formation of a scroll or volute (as illustrated in FIG. 11) such that the interior cavity may function as a collector volume and may collect the first fluid emanating from the plural tubes.

In one example, the inner annular support member may receive the first fluid from the first reservoir, the fluid may be directed through the plural passages of the plural tubes, and the interior cavity of the outer annular support member may receive the first fluid from the plural passages. The second conduit directs the first fluid out of the interior cavity of the outer annular support member and toward the second reservoir. The second conduit may be coupled with or include a flow regulation device (not shown), such as a valve, baffle, louver, or the like, to control the flow of the first fluid out of the interior cavity of the outer annular support member. In one or more embodiments, the second conduit may direct the first fluid out of the interior cavity as an exhaust and out of the thermal management system. Optionally, the first fluid may be directed into the second reservoir, where the first fluid may be recycled within the power system or equipment including the thermal management system, directed to another system, or the like. The positioning of the first and second reservoirs relative to the apparatus, and the directions of the first fluid moving out of the first reservoir and into the second reservoir are for illustrative purposes only. In alternative embodiments, the first fluid may be directed in any alternative radial directions into and/or out of the apparatus.

In one or more embodiments, the inner annular support member may have plural interior cavities. Optionally, the outer annular support member may have plural interior cavities. In one example, each of the plural interior cavities of the inner annular support member may be fluidly coupled with the first reservoir. Optionally, each of the plural interior cavities of the outer annular support member may be fluidly coupled with the second reservoir. In one embodiment, the plural interior cavities of the inner annular support member may be fluidly separate from each other, and may be manufactured as segmented, separate, or integral structures relative to one or more other interior cavities of the inner annular support member. Optionally, the plural interior cavities of the outer annular support member may be fluidly separate from each other, and may be manufactured as segmented, separate, or integral structures relative to one or more other interior cavities of the outer annular support member.

In one or more embodiments, one or more portions of the apparatus including the inner and outer annular support members and the plural tubes may be manufactured additively as a single, unitary component. For example, the apparatus may be formed as a unitary structure from a single piece or body. For example, the apparatus may be formed as a homogenous single component, rather than a non-homogenous component or a component formed by two or more separate bodies that are then combined with each other. The homogenous component may have the same consistency and/or chemical makeup throughout the entirety or substantially all of the component.

Optionally, in one or more embodiments, one or more portions of the apparatus may be formed via one or more additive manufacturing methods, and may be coupled with other portions of the apparatus via non-additive manufacturing methods. Additively manufacturing the apparatus of the thermal management system allows for the apparatus to be more compact relative to manufacturing the system using non-additively manufacturing methods, such as extruding, stamping, casting, forging, or the like. Additionally, additively manufacturing the apparatus allows the apparatus to having varying three-dimensional shapes, to have multi-domain cooling techniques (e.g., different cooling channels or conduits), or the like, within the same unitary component. Additive manufacturing can involve joining or solidifying material under computer control to create a three-dimensional object, such as by adding liquid molecules or fusing powder grains with each other. Examples of additive manufacturing include three-dimensional (3D) printing, rapid prototyping (RP), direct digital manufacturing (DDM), selective laser melting (SLM), electron beam melting (EBM), direct metal laser melting (DMLM), direct energy deposition (DED), or the like. Alternatively, the thermal management system, or a portion of the apparatus, can be formed in another manner.

The plural tubes may be separated from each other in the axial and circumferential directions such as to create or form spaces or voids disposed between two or more adjacent tubes. The spaces or voids may be sized and positioned to allow movement of a second fluid 1078 (e.g., air, gas, a coolant liquid, or the like) to move along exterior surfaces of the plural tubes. For example, the second fluid may exchange thermal energy with the first fluid moving within the apparatus. For example, the plural tubes may be arranged in a grid arrangement that is offset in both circumferential and axial directions to form fluid passages for the second fluid. In one or more embodiments, the plural tubes may be described as being arranged in a spiral arrangement that extend in a direction of tangential velocity from the second fluid control device.

In the illustrated embodiment of FIG. 10, the thermal management system may include a second fluid control device 1076. In one embodiment, the second fluid control device may be a fan, a blower, or the like, that directs the second fluid (e.g., ambient air, gas, a liquid such as a coolant, or the like) in a direction toward the front side of the apparatus. Optionally, the second fluid control device may be disposed on another side of the apparatus such that the second fluid control device may direct the second fluid toward the rear side of the apparatus. Additionally or alternatively, the thermal management system may include two or more different fans and/or pumps that may pull and/or push the second fluid toward the front side and away from the rear side of the apparatus, or toward the rear side and away from the front side of the apparatus. In one or more embodiments, the second fluid control device may have a size that is substantially the same as a size of the apparatus such that the second fluid control device may direct the second fluid toward substantially all or a majority of the apparatus. Optionally, the thermal management system may include plural fans, such that one fan directs a first portion of the second fluid toward a first area or first portion of the apparatus, and a second fan directs a second portion of the second fluid toward a second area or second portion of the apparatus.

In one or more embodiments, the first fluid that moves within the apparatus may be a liquid, a gas, a liquid-gas mixture, a liquid or gas carrying a dispersed solid, an emulsion, an aerosol, or another media. Additionally, the second fluid that moves outside of the apparatus may be a liquid, a gas, a liquid-gas mixture, or another media that may be the same or different than the first fluid. For example, the first fluid may be water, and the second fluid may be air. Optionally, the first and second fluids may be any alternative phases of different materials.

In one embodiment, the first fluid may be directed into the apparatus via the inner annular support member, and directed out of the apparatus via the outer annular support member. The first fluid received within the interior cavity of the outer annular support member may have an amount of thermal energy that is different than the first fluid that is received within the interior cavity of the inner annular support member. For example, the first fluid directed into the inner annular support member may have a temperature that is greater than a temperature of the first fluid after the first fluid moves through the plural tubes and is directed into the outer annular support member. As the first fluid moves through the apparatus from the interior cavity of the inner annular support member, through the plural tubes, and into the interior cavity of the outer annular support member, the first fluid may exchange thermal energy with the second fluid moving outside of the apparatus. For example, the second fluid may receive thermal energy from the first fluid such that the second fluid cools the first fluid.

In the illustrated embodiment, the apparatus may include the first, second, third, and fourth sets of plural tubes that are disposed within a first axial plane between the front and rear sides of the apparatus. Optionally, the apparatus may include plural sets of plural tubes that may be disposed in plural different axial planes between the front and rear sides. The different sets of the plural tubes disposed within the different axial planes (e.g., that are perpendicular to the center axis of the apparatus) may be aligned with each corresponding sets of plural tubes. For example, the first set 1040A of plural tubes are disposed within a first axial plane, and another first set of plural tubes (not shown) may be disposed within a second axial plane of the apparatus that is parallel with the first axial plane and disposed between the first axial plane and the rear side of the apparatus.

FIG. 18 illustrates a flowchart 1800 of a method for controlling fluids within a thermal management system in accordance with one embodiment. At step 1802, a first fluid may be directed into an interior cavity of one of an inner annular support member or an interior cavity of an outer annular support member of an apparatus. The first fluid may be received from a reservoir that may be a part of a power system or equipment that may include the apparatus of a thermal management system. At step 1804, portions of the first fluid may be directed to move from the interior cavity and through interior passages of plural tubes coupled with the inner annular support member and the outer annular support member. The plural tubes may extend along linear and/or curved pathways between the inner annular support member and the outer annular support member of the apparatus. The linear pathways may extend radially between the inner and outer annular support members. Optionally, the curved pathways of the plural tubes may be in golden spiral pathways, logarithmic spiral pathways, approximate golden spiral curves, non-uniform rational basis spline (NURBS) based curves, freeform curves, curves defined by splines, mathematically represented curves or the like. Optionally, the plural tubes may be positioned to direct the portions of the fluid in the clockwise direction or the counter-clockwise direction out of the first interior cavity.

At step 1806, a second fluid may be directed across one or more exterior surfaces of the apparatus, such as exterior surfaces of one or more of the plural tubes, surfaces of the inner annular support member, surfaces of the outer annular support member, or the like. The second fluid may be promoted to move across the exterior surfaces by a fluid control device, such as a fan, a blower, a pump, or the like. The first and second fluids may be the same or different phases of the same or similar fluids, or may be different fluids. For example, the first fluid may be compressed air, and the second fluid may be a liquid coolant.

At step 1808, as the first fluid moves along the curved pathways of the plural tubes, and the second fluid moves across the exterior surfaces of the apparatus, the first and second fluid may exchange thermal energy with each other. For example, the first fluid may have a temperature that is greater than the second fluid, and the second fluid may be used to cool or reduce the temperature of the first fluid moving within the apparatus. At step 1810, the portions of the first fluid moving within the plural tubes may be received within the interior cavity of the other of the inner or outer annular support members. For example, in one embodiment, the first fluid may be directed into the inner annular support member, through the plural tubes, and out of the plural tubes and into the outer annular support member. In another embodiment, the first fluid may be directed into the outer annular support member, through the plural tubes, and out of the plural tubes and into the inner annular support member. The first fluid may be directed out of the interior cavity of the inner or outer annular support member and toward a reservoir, may be directed out of the system as an exhaust, stored in separated fluid zones, or the like.

As explained above, the inner annular support member may be nested within the outer annular support member such that the inner annular support member is positioned within an area defined by the outer annular support member in at least one direction. In one embodiment, the inner annular support member and the outer annular support member are co-planar, such that the inner annular support member is located on a same plane as the outer annular support member and within an area of that plane bounded by the outer annular support member. In another embodiment, the inner annular support member and the outer annular support member are non-coplanar. However, the inner annular support member is still positioned within an area defined by the outer annular support member in the sense that a projection of the inner annular support member (i.e., a mathematical projection) along a center axis of the inner annular support member and extending to the plane of the outer annular support member lies within an area of that plane bounded by the outer annular support member.

In one or more embodiments, an apparatus may include an outer annular support member that extends about an outer axis of the outer annular support member, and an inner annular support member that is nested within the outer annular support member. The inner annular support member extends about an inner axis of the inner annular support member. The inner annular support member has a size that is less than or equal to a size of the outer annular support member. The apparatus may include plural tubes that connect with and extend from the outer annular support member to the inner annular support member. Each of the plural tubes may extend along curved pathways between the outer annular support member and the inner annular support member.

Optionally, the outer axis may be aligned with the inner axis such that the outer annular support member and the inner annular support member are concentric with each other. Optionally, the outer annular support member and the inner annular support member may be coplanar. Optionally, the outer annular support member and the inner annular support member may be non-coplanar. Optionally, the curved pathways of each of the plural tubes are in a clockwise direction. Optionally, the plural tubes includes a first set of plural tubes and a second set of plural tubes extending from the outer annular support member to the inner annular support member. Optionally, the first set of the plural tubes may extend along curved pathways in a clockwise direction, and the second set of the plural tubes may extend along curved pathways in a counterclockwise direction. Optionally, each of the plural tubes may be fluidly separate from each other. Optionally, each of the plural tubes may be separated from each other in an axial direction. Optionally, the curved pathways of the plural tubes may be spiral curves along long axes of the plural tubes. Optionally, the curved pathways of the plural tubes may curve in one or more of a golden spiral, a logarithmic spiral, an approximate golden spiral, a non-uniform rational basis spline (NURBS) based curve, a freeform curve, a curve defined by splines, or a mathematically represented curve. Optionally, each of the plural tubes may include one or more surfaces defining interior passages extending between the outer annular support member and the inner annular support member. The inner annular support member may include one or more surfaces defining a first interior cavity of the inner annular support member, and the outer annular support member may include one or more surfaces defining a second interior cavity of the inner annular support member. The first interior cavity, the interior passages, and the second interior cavity are fluidly coupled with each other. Optionally, a thermal management system may include the apparatus. A fluid may be directed into the inner annular support member, through the plural tubes, and through the outer annular support member. Optionally, the thermal management system may include one or more fluid control devices coupled with the apparatus. The one or more fluid control devices may direct the fluid through the plural tubes.

In one or more embodiments, a method may include directing a fluid into a first interior cavity of an inner annular support member of an apparatus, and directing the fluid out of the first interior cavity and through plural tubes connected with and radially extending from the inner annular support member to an outer annular support member. Each of the plural tubes may include one or more surfaces defining interior passages of the plural tubes. Each of the plural tubes may extend along curved pathways between the outer annular support member and the inner annular support member. The fluid may be received within a second interior cavity of the outer annular support member of the apparatus. The inner annular support member may be nested within the outer annular support member.

In one or more embodiments, a thermal management system may include an inner annular support member that extends about an axis. The inner annular support member may include one or more surfaces defining a first interior cavity. An outer annular support member extends about the axis such that the inner annular support member and the outer annular support member are concentric. The inner annular support member being nested within the outer annular support member. The outer annular support member may include one or more surfaces defining a second interior cavity. The thermal management system includes plural tubes connected and radially extending from the outer annular support member to the inner annular support member. Each of the plural tubes may include one or more surfaces defining interior passages of each of the plural tubes. Each of the plural tubes may extend along curved pathways between the outer annular support member and the inner annular support member. The curved pathways of the plural tubes may be spiral curves along long axes of the plural tubes. The first interior cavity is fluidly coupled with each of the interior passages and the second interior cavity. A fluid may be directed through the first interior cavity toward one or more of the interior passages, and through the one or more interior passages toward the second interior cavity.

Optionally, the thermal management system may include one or more fluid control devices operably coupled with one or more of the outer annular support member or the inner annular support member. The one or more fluid control devices may control one or more characteristics of the fluid moving through the thermal management system. Optionally, the plural tubes may be a first set of plural tubes. The thermal management system may include a second set of plural tubes radially extending from the outer annular support member to the inner annular support member. Optionally, the first set of plural tubes may be coplanar in a first plane, and the second set of plural tubes may be coplanar in a second plane that is parallel with the first plane. Optionally, the first set of plural tubes may extend along curved pathways in a clockwise direction, and the second set of plural tubes may extend along curved pathways in a counterclockwise direction. Optionally, the first set of the plural tubes may be separated from each other by a first void, and the second set of the plural tubes may be separated from each other by a second void. The first set of the plural tubes may be separated from the second set of the plural tubes by a third void. Optionally, the outer annular support member and the inner annular support member are coplanar. Optionally, the curved pathways of the plural tubes are spiral curves along long axes of the plural tubes. Optionally, the curved pathways of the plural tubes are curved in one or more of a golden spiral, a logarithmic spiral, an approximate golden spiral, a non-uniform rational basis spline (NURBS) based curve, a freeform curve, a curve defined by splines, or a mathematically represented curve. Optionally, the outer annular support member may have a size that is greater than a size of the inner annular support member. Optionally, the outer annular support member and the inner annular support member may have a common shape.

In accordance with one example or aspect, an apparatus may include an outer annular support member extending about an outer axis and an inner annular support member that is nested within the outer annular support member. The inner annular support member extends about an inner axis. Plural tubes can be connected with and extend between the outer annular support member and the inner annular support member. Each of the plural tubes may extend between a first end operably coupled with the inner annular support member and a second end operably coupled with the outer annular support member. A first end of a first tube of the plural tubes may be offset from a first end of a second tube of the plural tubes in a circumferential direction and in an axial direction. A second end of the first tube may be offset from a second end of the second tube in the circumferential direction and in the axial direction. A first fluid may be directed into one of the inner annular support member or the outer annular support member, through the plural tubes, and out of the other of the inner annular support member or the outer annular support member.

Optionally, the plural tubes may be arranged in plural sets of plural tubes. A first tube in a first set of the plural sets may be axially aligned with a first tube of a second set of the plural sets. Optionally, The plural tubes of the first set may extend along first pathways between the outer annular support member and the inner annular support member, and the plural tubes of the second set of the plural sets may extend along second pathways between the outer annular support member and the inner annular support member that are different than the first pathways. Optionally, at least one tube of the first set of the plural sets may be aligned with at least one tube of the second set of the plural sets of the plural tubes in the circumferential direction. Optionally, the at least one tube of the first set of the plural sets may be aligned with the at least one tube of the second set of the plural tubes in the axial direction. Optionally, each of the plural sets may include a same number of plural tubes. Optionally, the apparatus may include plural support structures operably coupled with and extending between the plural tubes. Optionally, the plural support structures may extend in the circumferential direction between the plural tubes. Optionally, a first support structure of the plural support structures may be operably coupled with a first tube of each of the plural sets of the plural sets of tubes, and a second support structure may be operably coupled with a second tube of each of the plural sets of the plural tubes.

Optionally, the apparatus may include plural groups of support structures. Each support structure of a first group of support structures of the plural groups may be operably coupled with a first tube of each of the plural sets of the plural sets of tubes, and each support structure of a second group of support structures may be operably coupled with a second tube of each of the plural sets of the plural tubes. Optionally, each support structure of the first group of support structures may be aligned with each other support structure of the first group in the axial direction, and each support structure of the first group of support structures may be offset from each other support structure of the first group in a radial direction. Optionally, each of the plural tubes may include one or more surfaces defining interior passages extending between the inner annular support member and the outer annular support member. The first fluid may move within the interior passages of the plural tubes, and a second fluid may move outside of and around exterior surfaces of the plural tubes and around exterior surfaces of the plural support structures. Optionally, each of the plural tubes may extend along curved pathways between the inner annular support member and the outer annular support member. Optionally, each of the plural tubes may extend radially along linear pathways between the inner annular support member and the outer annular support member. Optionally, each of the plural tubes may include one or more surfaces defining interior passages extending between the inner annular support member and the outer annular support member. The inner annular support member may include one or more surfaces defining a first interior cavity of the inner annular support member, and the outer annular support member may include one or more surfaces defining a second interior cavity of the outer annular support member. The first cavity, the interior passages, and the second interior cavity may be fluidly coupled with each other. Optionally, a thermal management system may include the apparatus, and may include a first fluid control device that may direct the first fluid through the plural tubes, and a second fluid control device that may direct a second fluid around exterior surfaces of the plural tubes.

In accordance with one example or aspect, a thermal management system may include an outer annular support member that extends about an outer axis, and an inner annular support member that is nested within the outer annular support member and extends about an inner axis. The thermal management system can include plural tubes connected with and radially extending between the outer annular support member and the inner annular support member. Each of the plural tubes may extend between a first end operably coupled with the inner annular support member and a second end operably coupled with the outer annular support member. A first end of a first tube of the plural tubes may be offset from a first end of a second tube of the plural tubes in a circumferential direction and in an axial direction; and a second end of the first tube may be offset from a second end of the second tube in the circumferential direction and the axial direction. The first end of the first tube may be aligned with the second end of the first tube in the axial direction and the first end of the first tube may be offset from the second end of the first tube in the circumferential direction. The first end of the second tube may be aligned with the second end of the second tube in the axial direction, and the first end of the second tube may be offset from the second end of the second tube in the circumferential direction. A first fluid may be directed into one of the inner annular support member or the outer annular support member, through the plural tubes, and out of the other of the inner annular support member or the outer annular support member.

Optionally, the plural tubes may be arranged in plural sets of plural tubes. A first tube of a first set of the plural tubes may be axially aligned with a first tube of a second set of the plural sets.

Optionally, the thermal management system may include plural support structures operably coupled with and extending between the plural tubes. The plural support structures may extend in the circumferential direction between the plural tubes. Each support structure of a first group of support structures of the plural support structures may be operably coupled with a first tube of each of the plural sets of the plural sets of tubes, and each support structure of a second group of support structures may be operably coupled with a second tube of each of the plural sets of the plural tubes. Optionally, each support structure of the first group of support structures may be aligned with each other support structure of the first group in the axial direction, and each support structure of the first group of support structures may be offset from each other support structure of the first group in a radial direction. Optionally, each of the plural tubes may extend along curved pathways between the inner annular support member and the outer annular support member. Optionally, each of the plural tubes may extend radially along linear pathways between the inner annular support member and the outer annular support member.

As used herein, the terms "processor" and "computer," and related terms, e.g., "processing device," "computing device," and "controller" may be not limited to just those integrated circuits referred to in the art as a computer, but refer to a microcontroller, a microcomputer, a programmable logic controller (PLC), field programmable gate array, and application specific integrated circuit, and other programmable circuits. Suitable memory may include, for example, a computer-readable medium. A computer-readable medium may be, for example, a random-access memory (RAM), a computer-readable non-volatile medium, such as a flash memory. The term "non-transitory computer-readable media" represents a tangible computer-based device implemented for short-term and long-term storage of information, such as, computer-readable instructions, data structures, program modules and sub-modules, or other data in any device. Therefore, the methods described herein may be encoded as executable instructions embodied in a tangible, non-transitory, computer-readable medium, including, without limitation, a storage device and/or a memory device. Such instructions, when executed by a processor, cause the processor to perform at least a portion of the methods described herein. As such, the term includes tangible, computer-readable media, including, without limitation, non-transitory computer storage devices, including without limitation, volatile and non-volatile media, and removable and non-removable media such as firmware, physical and virtual storage, CD-ROMS, DVDs, and other digital sources, such as a network or the Internet.

As used herein, an element or step recited in the singular and proceeded with the word "a" or "an" do not exclude the plural of said elements or operations, unless such exclusion is explicitly stated. Furthermore, references to "one embodiment" of the invention do not exclude the existence of additional embodiments that incorporate the recited features. Moreover, unless explicitly stated to the contrary, embodiments "comprising," "comprises," "including," "includes," "having," or "has" an element or a plurality of elements having a particular property may include additional such elements not having that property. In the appended claims, the terms "including" and "in which" are used as the plain-English equivalents of the respective terms "comprising" and "wherein." Moreover, in the following claims, the terms "first," "second," and "third," etc. are used merely as labels, and do not impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function devoid of further structure.

The above description is illustrative, and not restrictive. For example, the above-described embodiments (and/or aspects thereof) may be used in combination with each other. In addition, many modifications may be made to adapt a particular situation or material to the teachings of the subject matter without departing from its scope. While the dimensions and types of materials described herein define the parameters of the subject matter, they are exemplary embodiments. Other embodiments will be apparent to one of ordinary skill in the art upon reviewing the above description. The scope of the subject matter should, therefore, be determined with reference to the appended claims, along with the full scope of equivalents to which such claims are entitled.

This written description uses examples to disclose several embodiments of the subject matter, including the best mode, and to enable one of ordinary skill in the art to practice the embodiments of subject matter, including making and using any devices or systems and performing any incorporated methods. The patentable scope of the subject matter is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal languages of the claims.

This written description uses examples to disclose the embodiments, including the best mode, and to enable a person of ordinary skill in the art to practice the embodiments, including making and using any devices or systems and performing any incorporated methods.

What is claimed is:

1. An apparatus, comprising:

an outer annular support member extending about an outer axis;

an inner annular support member that is nested within the outer annular support member, the inner annular support member extending about an inner axis, the inner annular support member having a size that is less than a size of the outer annular support member;

a first set of plural tubes connected with and radially extending between the outer annular support member and the inner annular support member, each of the first set of plural tubes radially extending along curved pathways in a clockwise direction from a first end operably coupled with the inner annular support member to a second end operably coupled with the outer annular support member; and a second set of plural tubes connected with and radially extending between the outer annular support member and the inner annular support member, each of the second set plural tubes radially extending along curved pathways in a counterclockwise direction from a first end operably coupled with the inner annular support member to a second end operably coupled with the outer annular support member.

2. The apparatus of claim 1, wherein the curved pathways of the plural tubes are curved in one or more of a golden spiral, a logarithmic spiral, an approximate golden spiral, a non-uniform rational basis spline (NURBS) based curve, a freeform curve, a curve defined by splines, or a mathematically represented curve.

3. An apparatus, comprising:

an outer annular support member extending about an outer axis;

an inner annular support member that is nested within the outer annular support member, the inner annular support member extending about an inner axis, the inner annular support member having a size that is less than a size of the outer annular support member;

plural tubes connected with and radially extending between the outer annular support member and the inner annular support member, each of the plural tubes radially extending along a linear pathway from a first end operably coupled with the inner annular support member to a second end operably coupled with the outer annular support member, wherein:

the first end of each of the plural tubes is axially offset from the second end along an axial direction of the inner axis the plural tubes comprise a first set of plural tubes and a second set of plural tubes, the first ends of the first plural tubes are axially aligned along a first plane, and the first ends of the second plural tubes are axially aligned along a second plane offset from the first plane; and the second ends of the first plural tubes and the second plural tubes are axially aligned along a third plane offset from the first plane and the second plane.

4. The apparatus of claim 3, wherein the plural tubes of the first set radially extend along first linear pathways between the outer annular support member and the inner annular support member, and the plural tubes of the second set of the plural sets of tubes radially extend along second linear pathways between the outer annular support member and the inner annular support member that are different than the first pathways.

5. The apparatus of claim 4, wherein at least one tube of the first set of the plural sets is aligned with at least one tube of the second set of the plural tubes in the circumferential direction.

6. The apparatus of claim 3, further comprising one or more support structures operably coupled with and extending between at least two of the plural tubes.

7. The apparatus of claim 1, wherein the outer axis is aligned with the inner axis such that the outer annular support member and the inner annular support member are concentric with each other.

8. The apparatus of claim 1, wherein the outer annular support member and the inner annular support member are coplanar.

9. The apparatus of claim 1, wherein each of the plural tubes include one or more surfaces defining interior passages extending between the outer annular support member and the inner annular support member, the inner annular support member including one or more surfaces defining a first interior cavity of the inner annular support member, and the outer annular support member including one or more surfaces defining a second interior cavity of the outer annular support member, wherein the first interior cavity, the interior passages, and the second interior cavity are fluidly coupled with each other.

10. A thermal management system comprising the apparatus of claim 1, wherein a fluid is configured to be directed into the inner annular support member, through the plural tubes, and through the outer annular support member, and further comprising one or more fluid control devices to direct one or more of a first fluid to move through the plural tubes or a second fluid to move around exterior surfaces of the plural tubes.

11. A method of operating the apparatus of claim 1, the method comprising:

directing a fluid into a first interior cavity of the inner annular support member of the apparatus;

directing the fluid out of the first interior cavity and through the first plural tubes and the second plural tubes; and receiving the fluid within a second interior cavity of the outer annular support member of the apparatus.

12. A thermal management system comprising:

an inner annular support member extending about an axis, the inner annular support member including one or more surfaces defining a first interior cavity;

an outer annular support member extending about the axis such that the inner annular support member and the outer annular support member are concentric, the inner annular support member being nested within the outer annular support member, the outer annular support member including one or more surfaces defining a second interior cavity; and plural tubes connected with and radially extending between the outer annular support member to the inner annular support member, each of the plural tubes including one or more surfaces defining interior passages of each of the plural tubes, wherein each of a first subset of the plural tubes radially extend along curved pathways in a clockwise direction from the inner annular support member to the outer annular support member, wherein each of a second subset of the plural tubes radially extend along curved pathways in a counter-clockwise direction from the inner annular support member to the outer annular support member, wherein the first interior cavity is fluidly coupled with each of the interior passages and the second interior cavity, and wherein a first fluid is configured to be directed through the first interior cavity toward one or more of the interior passages, and through the one or more of the interior passages toward the second interior cavity.

13. The thermal management system of claim 12, wherein the curved pathways of the first subset and second subset of the plural tubes are spiral curves along long axes of the plural tubes.

14. The thermal management system of claim 12, wherein a first end of a first tube of the first subset of the plural tubes is offset from a first end of a second tube of the second subset of the plural tubes in a circumferential direction and in an axial direction, and a second end of the first tube is offset from a second end of the second tube in the circumferential direction and in the axial direction.

15. The apparatus of claim 1, wherein the first set of plural tubes extend between the outer annular support member and the inner annular support member along a first plane, the second set of plural tubes extend between the outer annular support member and the inner annular support member along a second plane different from the first plane.

16. The apparatus of claim 15, wherein the first plane is parallel to the second plane.

17. The apparatus of claim 15, wherein the first plane is angled relative to the second plane.

* * * * *